US012545461B2

(12) United States Patent
Hennissen

(10) Patent No.: US 12,545,461 B2
(45) Date of Patent: Feb. 10, 2026

(54) VERTICAL FORM FILL SEALING MACHINE AND METHOD FOR OPERATING THE VERTICAL FORM FILL SEALING MACHINE

(71) Applicant: Syntegon Packaging Solutions B.V., Weert (NL)

(72) Inventor: Maurice Hennissen, Weert (NL)

(73) Assignee: Syntegon Packaging Solutions B.V., Weert (NL)

( * ) Notice: Subject to any disclaimer, the term of this patent is extended or adjusted under 35 U.S.C. 154(b) by 0 days.

(21) Appl. No.: 18/705,231

(22) PCT Filed: Nov. 3, 2022

(86) PCT No.: PCT/EP2022/080631
§ 371 (c)(1),
(2) Date: Apr. 26, 2024

(87) PCT Pub. No.: WO2023/078972
PCT Pub. Date: May 11, 2023

(65) Prior Publication Data

US 2025/0002196 A1 Jan. 2, 2025

(30) Foreign Application Priority Data

Nov. 5, 2021 (DE) ..... 10 2021 128 884.3

(51) Int. Cl.
*B65B 51/30* (2006.01)
*B65B 9/207* (2012.01)
*B65B 65/02* (2006.01)

(52) U.S. Cl.
CPC ..... *B65B 51/303* (2013.01); *B65B 9/207* (2013.01); *B65B 65/02* (2013.01)

(58) Field of Classification Search
CPC ..... B65B 9/2056; B65B 9/207; B65B 51/303; B65B 65/02
(Continued)

(56) References Cited

U.S. PATENT DOCUMENTS 3,026,658 A * 3/1962 Schneider et al. ..... B65B 9/213 53/551
3,256,673 A 6/1966 Tew et al.
(Continued)

FOREIGN PATENT DOCUMENTS

AT 502740 A2 5/2007
DE 69725928 T2 9/2004
(Continued)

OTHER PUBLICATIONS

German Patent Office Action for Application No. 102021128884.3 dated Jul. 14, 2022 (11 pages including English translation).
(Continued)

*Primary Examiner* — Stephen F. Gerrity
(74) *Attorney, Agent, or Firm* — Michael Best & Friedrich LLP

(57) ABSTRACT

A vertical form fill sealing machine includes a machine frame and at least one transverse sealing device for sealing a packaging material transversely. The transverse sealing device is mounted on the machine frame such that it can be rotated around a rotation axis of the transverse sealing device at least substantially as a whole. A guide unit guides the rotation of the transverse sealing device around the rotation axis at least substantially as a whole. The guide unit includes at least one guide element that delimits at least partially an at least substantially circular cylindrical receiving area within which the transverse sealing device is at least substantially completely arranged. The transverse sealing device includes at least one movement unit, at least two sealing jaws, and at least one guide unit to guide the at least two sealing jaws during a movement.

10 Claims, 11 Drawing Sheets

(58) Field of Classification Search
USPC ..... 53/451, 551
See application file for complete search history.

(56) References Cited

U.S. PATENT DOCUMENTS

| | | | | |
|---|---|---|---|---|
| 3,320,721 | A | 5/1967 | Murray | |
| 3,332,206 | A | 7/1967 | Murray | |
| 3,599,387 | A * | 8/1971 | James | B65B 51/303 53/551 |
| 3,616,087 | A | 10/1971 | Henry et al. | |
| 3,684,254 | A | 8/1972 | Henry | |
| 4,291,520 | A | 9/1981 | Prince et al. | |
| 4,537,012 | A | 8/1985 | Groom et al. | |
| 4,598,533 | A | 7/1986 | Takagaki | |
| 4,751,808 | A | 6/1988 | Hadden | |
| 5,203,145 | A | 4/1993 | Kammler et al. | |
| 5,279,098 | A | 1/1994 | Fukuda | |
| 5,540,035 | A | 7/1996 | Plahm et al. | |
| 5,746,043 | A | 5/1998 | Terminella et al. | |
| 5,881,539 | A | 3/1999 | Fukuda et al. | |
| 7,546,722 | B2 | 6/2009 | Tsuruta | |
| 8,539,741 | B2 | 9/2013 | Lubezny et al. | |
| 9,598,188 | B2 | 3/2017 | Fioravanti et al. | |
| 2002/0020153 | A1* | 2/2002 | Klinkel | B65B 9/207 53/551 |
| 2003/0217531 | A1 | 11/2003 | Keen et al. | |
| 2006/0018989 | A1 | 1/2006 | Woods et al. | |
| 2008/0066430 | A1 | 3/2008 | Lubezny | |
| 2011/0005172 | A1* | 1/2011 | Miyahara et al. | B65B 9/20 53/575 |
| 2013/0298502 | A1 | 11/2013 | Ansinn et al. | |
| 2017/0113823 | A1* | 4/2017 | Wolf et al. | B65B 9/207 |
| 2022/0168967 | A1 | 6/2022 | Frei et al. | |

FOREIGN PATENT DOCUMENTS

| | | | | |
|---|---|---|---|---|
| DE | 102006025849 | A1 | 12/2007 | |
| EP | 2103526 | A1 | 9/2009 | |
| EP | 3239060 | A1 | 11/2017 | |
| GB | 886223 | A | 1/1962 | |
| JP | S6278033 | A | 4/1987 | |
| JP | H01308707 | A | 12/1989 | |
| JP | 201694233 | A | 5/2016 | |
| JP | 2016088619 | A | 5/2016 | |
| JP | 2016094223 | A | 5/2016 | |
| WO | 2016185875 | A1 | 11/2016 | |
| WO | 2017086038 | A1 | 5/2017 | |
| WO | WO-2019077532 | A1 * | 4/2019 | B65B 51/303 |
| WO | 2020059312 | A1 | 3/2020 | |

OTHER PUBLICATIONS

International Preliminary Report on Patentability for Application No. PCT/EP2022/080631 dated May 2, 2024 (7 pages).
International Search Report for Application No. PCT/EP2022/080631 dated Feb. 24, 2023 (3 pages).
European Patent Office Action for Application No. 22805905.1 dated Jul. 2, 2024 (4 pages).
Japanese Patent Office Action for Application No. 2024526717 dated Mar. 5, 2025 (7 pages including English translation).
Australian Patent Office Action for Application No. 2022383483 dated May 30, 2025 (4 pages).
Japanese Patent Office Action for Application No. 2024526717 dated Sep. 11, 2025 (8 pages including English machine translation).
European Patent Office Notice of Opposition for Application No. 22817103.9 dated Oct. 16, 2025 (23 pages).

* cited by examiner

VERTICAL FORM FILL SEALING MACHINE AND METHOD FOR OPERATING THE VERTICAL FORM FILL SEALING MACHINE

BACKGROUND

A vertical form fill sealing machine, comprising a machine frame and at least one transverse sealing device for sealing of a packaging material transversely, wherein the transverse sealing device is mounted on the machine frame such that it can be rotated around a rotation axis of the transverse sealing device at least substantially as a whole, and a guide unit to guide the rotation of the transverse sealing device around the rotation axis at least substantially as a whole has already been proposed. Such vertical form fill sealing machines are for example disclosed in U.S. Pat. Nos. 3,320,721 A, 3,332,206 A, JP 2016-94 223 A, WO 2016/185875 A1, EP 3 239 060 A1 and US 2003/0217531 A.

SUMMARY

The invention is based on a vertical form fill sealing machine comprising a machine frame and at least one transverse sealing device sealing of a packaging material transversely, wherein the transverse sealing device is mounted on the machine frame such that it can be rotated around a rotation axis of the transverse sealing device at least substantially as a whole, and a guide unit to guide the rotation of the transverse sealing device around the rotation axis at least substantially as a whole, wherein the guide unit comprises at least one guide element that delimits at least partially an at least substantially circular cylindrical receiving area within which the transverse sealing device is at least substantially completely arranged, wherein the transverse sealing device comprises at least one movement unit, at least two sealing jaws and at least one guide unit to guide the at least two sealing jaws during a movement.

It is proposed that the at least one movement unit is provided for moving the at least two sealing jaws along a horizontal movement axis of the guide unit of the transverse sealing device and for moving the at least two sealing jaws along a vertical movement axis of the guide unit of the transverse sealing device. The term "substantially completely" is here in particular to mean at least 50%, preferably 75% and particularly preferably at least 90% of a total volume of an object, preferably of a total volume of a circular cylinder that just completely encloses the object, and/or a total mass of the object, in particular of the transverse sealing device. The guide unit of the vertical form fill sealing machine is preferably arranged at least partially on the machine frame. The at least one guide element of the guide unit of the vertical form fill sealing machine is preferably arranged on the machine frame. Particularly preferably, the at least one guide element of the guide unit of the vertical form fill sealing machine is implemented integrally with the machine frame. "Implemented integrally" is in particular to mean connected at least by substance-to-substance bond, for example by a welding process, a gluing process, an injection-molding process, and/or another process that is deemed expedient by someone skilled in the art, and/or advantageously formed in one piece, like for example by a production from a cast and/or by a production in a one-component or multi-component injection-molding procedure, and advantageously f rom a single blank. Alternatively, it is also conceivable that the guide element of the guide unit of the vertical form fill sealing machine is arranged in a detachable, in particular a non-destructive, manner on the machine frame. The at least one guide element of the guide unit of the vertical form fill sealing machine is in particular circle-shaped, at least viewed in a direction parallel to the rotation axis of the transverse sealing device. Preferably, the at least one guide element of the guide unit of the vertical form fill sealing machine has an annulus-form, particularly preferable an annulus-segment-form, at least viewed in the direction parallel to the rotation axis of the transverse sealing device. In particular, in at least one preferred embodiment, the at least one guide element of the guide unit of the vertical form fill sealing machine has a hollow-cylinder form, wherein the guide element of the guide unit of the vertical form fill sealing machine preferably has at each end of the hollow-cylinder-formed guide element of the guide unit of the vertical form fill sealing machine a protrusion, particularly preferable on an inside wall of the guide element of the guide unit of the vertical form fill sealing machine. The inside wall preferably is at least substantially circular-cylinder-shaped, in particular except from the protrusions. At least part of the transverse sealing device is in particular arranged between the protrusions of the guide element of the guide unit of the vertical form fill sealing machine, preferably in contact with the protrusions. Preferably, the at least one guide element of the guide unit of the vertical form fill sealing machine has a guide rail, a guide groove or the like, which is in particular at least in the preferred embodiment arranged on one of the protrusions of the guide element of the guide unit of the vertical form fill sealing machine. Alternatively or additionally, it is also conceivable that the guide element of the guide unit of the vertical form fill sealing machine has at least one guide knob, at least one guide stud or the like. Furthermore, it is also conceivable alternatively that the guide element of the guide unit of the vertical form fill sealing machine is implemented as a guide rail, a guide groove, a guide knob, a guide stud or the like. It is conceivable that the guide unit of the vertical form fill sealing machine comprises a plurality of guide elements, which are arranged in a circular manner. It is conceivable that the at least one guide element of the guide unit of the vertical form fill sealing machine has a plurality of snap-in points, in particular spaced-apart from each other, along a guide direction of the at least one guide element, wherein the transverse sealing device can be snapped in at the snap-in points. Alternatively, it is also conceivable that the at least one guide element of the guide unit of the vertical form fill sealing machine is free from any snap-in points. Preferably, the transverse sealing device can be fixed steplessly along the at least one guide element of the guide unit of the vertical form fill sealing machine, e.g. via a clamping connection or the like. In particular, the at least one guide element of the guide unit of the vertical form fill sealing machine is arranged on an inner wall of the machine frame. Preferably, the at least one guide element of the guide unit of the vertical form fill sealing machine is implemented integrally with the inner wall of the machine frame. Alternatively, it is also conceivable that the at least one guide element of the guide unit of the vertical form fill sealing machine is arranged detachably on the inner wall of the machine frame, in particular in a non-destructive manner. The inner wall of the machine frame is preferably arranged on a side of the machine frame that faces towards the transverse sealing device. It is conceivable, that the inner wall is at least partially circular cylindrical shaped. It is alternatively also conceivable, that the inner wall is plane or has a polygonal shape, at least viewed in a direction parallel to the rotation axis.

The guide unit of the vertical form fill sealing machine comprises in particular at least one further guide element, which is arranged on the transverse sealing device. The at least one further guide element of the guide unit of the vertical form fill sealing machine is implemented as a guide rail, a guide groove, a guide knob, a guide stud or the like. It is also conceivable that the guide unit of the vertical form fill sealing machine comprises a plurality of further guide elements, which are arranged on the transverse sealing device. The at least one further guide element of the guide unit of the vertical form fill sealing machine is preferably implemented correspondingly to the at least one guide element of the guide unit of the vertical form fill sealing machine. The at least one further guide element of the guide unit of the vertical form fill sealing machine is in particular arranged on a bottom side or a top side of the transverse sealing device, at least viewed in the direction parallel to the rotation axis. Alternatively, it is also conceivable that the at least one further guide element of the guide unit of the vertical form fill sealing machine is arranged laterally to the transverse sealing device, at least viewed in the direction parallel to the rotation axis. Preferably, the at least one further guide element of the guide unit of the vertical form fill sealing machine is implemented integrally with the transverse sealing device. Alternatively, it is also conceivable, that the at least one further guide element of the guide unit of the vertical form fill sealing machine is arranged detachably on the transverse sealing device, in particular in a non-destructive manner.

It is conceivable that the guide unit of the vertical form fill sealing machine and/or the machine frame have/has one or more bearing points, in which the transverse sealing device, in particular a frame of the transverse sealing device, is movably connected to the guide unit of the vertical form fill sealing machine, and/or to the machine frame. In a preferred embodiment, at least one bearing point is arranged on a bottom side or a top side of the transverse sealing device, at least viewed in the direction parallel to the rotation axis, preferably on at least one of the protrusions of the guide element of the guide unit of the vertical form fill sealing machine. It is also conceivable that at least one bearing point is located laterally to the transverse sealing device. Alternatively or additionally, at least one bearing point is located centrally relative to the transverse sealing device on the bottom side or the top side of the transverse sealing device, at least viewed in the direction parallel to the rotation axis, in particular in such a way that the rotation axis of the transverse sealing device goes through the at least one bearing point.

The circular cylindrical shaped receiving area is in particular at least partially delimited by the inside wall of the guide element of the guide unit of the vertical form fill sealing machine. The protrusions of the guide element of the guide unit of the vertical form fill sealing machine in the preferred embodiment protrude in particular into the cylindrical shaped receiving area. Preferably, a curvature, in particular a curvature radius of the curvature, of the at least one guide element of the guide unit of the vertical form fill sealing machine, in particular of the inside wall of the guide element, is equivalent to a curvature, in particular a curvature radius of the curvature, of the at least substantially circular cylindrical receiving area. The at least substantially circular cylindrical receiving area is preferably encompassed along a circumferential direction of the at least substantially circular cylindrical receiving area by the at least one guide element of the guide unit of the vertical form fill sealing machine, in particular the inside wall of the guide element, by at least 75°. The circumferential direction of the at least substantially circular cylindrical receiving area preferably runs in a plane which is perpendicular to a main extension axis of the at least substantially circular cylindrical receiving area. By a "main extension axis" of an object or an area is herein in particular an axis to be understood which extends parallel to a longest edge of a smallest geometric rectangular cuboid that just still completely encloses the object or the area respectively. It is conceivable, that the at least substantially circular cylindrical receiving area is encompassed by the at least one guide element of the guide unit of the vertical form fill sealing machine, in particular the inside wall of the guide element, along the circumferential direction of the at least substantially circular cylindrical receiving area by at least 90°, preferably by at least 135° and in particular by at least 180°. Alternatively, it is conceivable, that the at least substantially circular cylindrical receiving area is encompassed by the at least one guide element of the guide unit of the vertical form fill sealing machine, in particular the inside wall of the at least one guide element, along the circumferential direction of the at least substantially circular cylindrical receiving area by the at least one guide element of the guide unit of the vertical form fill sealing machine by less than 75°.

In particular, at least substantially all components of the transverse sealing device are simultaneously rotatable around the rotation axis of the transverse sealing device, preferably relative to the machine frame. Preferably, all components of the transverse sealing device other than the frame are mounted on the frame of the transverse sealing device. In particular, the frame of the transverse sealing device is arranged movably, preferably rotatably, on the machine frame. Particularly preferably, the transverse sealing device is mounted movably on the machine frame in such a way that the rotation axis of the transverse sealing device is positionally fixed relative to the machine frame, in particular independently from any operational movements of the transverse sealing device relative to the machine frame. In particular, the transverse sealing device is mounted on the machine frame in such a way that the transverse sealing device is merely movable at least substantially as a whole by a rotation of the transverse sealing device substantially as a whole around the rotation axis of the transverse sealing device. Preferably, a rotation of the transverse sealing device substantially as a whole relative to the machine frame is generatable free from any translational movements, in particular relative to the machine frame, of the transverse sealing device at least substantially as a whole. In particular, the transverse sealing device is mounted on the machine frame in such a way that the transverse sealing device substantially as a whole has only one degree of freedom to move. Alternatively, it is also conceivable that the transverse sealing device is mounted on the machine frame in such a way that the transverse sealing device can be moved translationally, in particular along a translational-movement axis of the transverse sealing device, preferably relative to the machine frame. The rotation axis of the transverse sealing device runs at least substantially perpendicularly to a support surface of the machine frame. The support surface of the machine frame is preferably intended to transmit weight forces of the vertical form fill sealing machine, in particular the machine frame, to a floor on which the vertical form fill sealing machine is arranged. The support surface of the machine frame is in particular part of a stand of the machine frame, of a bottom surface of the machine frame, or the like.

In particular, the transverse sealing device comprises the at least two sealing jaws. The at least two sealing jaws are preferably mounted movably on the frame of the transverse sealing device. The transverse sealing device comprises the guide unit for guiding the at least two sealing jaws during a horizontal and/or vertical movement relative to the frame. The transverse sealing device preferably comprises the at least one movement unit for moving the at least two sealing jaws, in particular translationally, preferably relative to each other, along a horizontal movement axis of the guide unit of the transverse sealing device and/or for moving the at least two sealing jaws, in particular translationally, along a vertical movement axis of the guide unit of the transverse sealing device. In particular, the transverse sealing device comprises at least two drive units for driving the movement unit so as to generate a horizontal movement and/or a vertical movement of the at least two sealing jaws, preferably relative to the frame and/or relative to the machine frame. Exemplarily, at least one drive unit of the at least two drive units of the transverse sealing device is implemented as an electromotor, as a pneumatic motor or as another drive unit that appears reasonable to a person skilled in the art.

Preferably, the horizontal movement axis of the guide unit of the transverse sealing device runs at least substantially perpendicularly to the rotation axis of the transverse sealing device. The term "substantially perpendicularly" is here in particular to mean an orientation of a direction relative to a reference direction, wherein the direction and the reference direction, in particular viewed in a projection plane, include a 90°-angle and the angle has a maximum deviation of in particular less than 8°, advantageously less than 5° and especially advantageously less than 2°. In particular, the vertical movement axis of the guide unit of the transverse sealing device runs at least substantially parallel to the rotation axis of the transverse sealing device. The term "substantially parallel" is here in particular to mean an orientation of a direction relative to a reference direction, in particular in a plane, wherein the direction has a deviation from the reference direction that is smaller than 8°, advantageously smaller than 5° and especially advantageously smaller than 2°. Preferably the at least two sealing jaws are configured to seal a packaging material, which is in particular arrangeable between the at least two sealing jaws. Each of the at least two sealing jaws has a sealing surface. Preferably, the sealing surfaces of the at least two sealing jaws are arranged facing each other. The sealing surfaces of the at least two sealing jaws are preferably in contact with the packaging material in a sealing position of the at least two sealing jaws in order to create a sealing in the packaging material. In particular, the sealing surfaces of the at least two sealing jaws run at least substantially parallel to each other. Preferably, the horizontal movement axis of the guide unit of the transverse sealing device runs at least substantially perpendicularly to the sealing surfaces of the at least two sealing jaws. The sealing surfaces of the at least two sealing jaws preferably run parallel to the vertical movement axis of the guide unit of the transverse sealing device. The rotation axis of the transverse sealing device in particular runs at least substantially parallel to the sealing surfaces of the at least two sealing jaws.

Preferably the transverse sealing device can be positioned in at least two work positions for the purpose of a transverse sealing a packaging material by means of a stepless rotation of the transverse sealing device, at least substantially as a whole, around the rotation axis relative to the machine frame. Preferably the stepless rotation of the transverse sealing device, at least substantially as a whole, around the rotation axis relative to the machine frame is a pure rotation, particularly preferably free from any translational movements of the transverse sealing device relative to the machine frame, in particular from a work position of the at least two work positions to a further work position of the at least two work positions. In particular, the transverse sealing device is mounted on the machine frame in such a way that the transverse sealing device can be positioned in at least two work positions for a transverse sealing of a packaging material free of any translational movement of the transverse sealing device at least substantially as a whole, preferably relative to the machine frame. Preferably, the transverse sealing device can be positioned in the at least two work positions for a transverse sealing of a packaging material solely by means of the rotation of the transverse sealing device, at least substantially as a whole, relative to the machine frame, in particular free from any additional, especially linearly guided, movements of the transverse sealing device, at least substantially as a whole, relative to the machine frame. The at least two work positions of the transverse sealing device preferably differ in a rotational position of the transverse sealing device, in particular at least substantially as a whole, relative to the machine frame. Preferably the at least two work positions of the transverse sealing device differ from each other by an angle of 90°. Alternatively, it is also conceivable that the at least two work positions of the transverse sealing device differ from each other by an angle that is different from 90°, preferably by an angle that greater than 0° and less than 360°. It is also conceivable that the transverse sealing device can be rotated over 360°, in particular by an integer or a non-integer multiple of 360°, relative to the machine frame. It is conceivable that energy supply lines of the vertical form fill sealing machine, which are configured for supplying the transverse sealing device with energy, are realized and/or arranged relative to the machine frame and/or the transverse sealing device such as to enable a 360° rotation, preferably a rotation over 360°, in particular a rotation by an integer or a non-integer multiple of 360°, of the transverse sealing device relative to the machine frame. Exemplarily the energy supply lines are arranged in combination with a slip ring, a rotary transformer, or the like of the vertical form fill sealing machine such as to enable a 360° rotation of the transverse sealing device relative to the machine frame. It is conceivable that the transverse sealing device is infinitely rotatable, at least substantially as a whole, around the rotation axis in a variety of different work positions for a transverse sealing of a packaging material. Alternatively, it is also conceivable that the transverse sealing device is rotatable, at least substantially as a whole, around the rotation axis of the transverse sealing device into fixed, in particular spaced-apart, rotational positions of the transverse sealing device relative to the machine frame, which in particular constitute different work positions of the transverse sealing device.

Preferably, the vertical form fill sealing machine comprises a drive unit for generating a rotation of the transverse sealing device at least substantially as a whole around the rotation axis. Exemplarily, the drive unit of the vertical form fill sealing machine is implemented as an electromotor, as a pneumatic motor or as another drive unit that appears reasonable to a person skilled in the art. Preferably, the vertical form fill sealing machine comprises a control unit for controlling a driving force of the drive unit of the vertical form fill sealing machine. In particular, the control unit comprises at least a processor and a storage element as well as an operation program stored on the storage element. The storage element is preferably implemented as a digital storage element, for example as a hard disk or the like. Particularly preferably, the control unit controls the drive of the drive unit of the vertical form fill sealing machine automatically, in particular depending on a running operation program of the control unit. Alternatively or additionally, it is conceivable that the vertical form fill sealing device comprises an input unit for manually controlling the drive unit of the vertical form fill sealing machine in order to rotate the transverse sealing device, at least substantially as a whole, around the rotation axis. Exemplarily, the input unit comprises a keyboard, a touchscreen, buttons, an adjustment wheel, or the like. It is conceivable that the input unit is attached to the machine frame or is part of an external unit such as a server, a smartphone, a laptop, a remote control, or the like, which in particular has a data connection to the control unit of the vertical form fill sealing machine. Furthermore, it is additionally or alternatively also conceivable that the vertical form fill sealing machine comprises at least one mechanical control element, which is configured to be operated manually by a user. Exemplarily, the at least one mechanical control element is implemented as a lever, as a mechanical adjustment wheel or the like. Preferably, the transverse sealing device is rotatable, at least substantially as a whole, by means of the drive unit of the vertical form fill sealing machine and/or manually by means of the at least one mechanical control element during an operation of the vertical form fill sealing machine, in particular during a sealing of the packaging material and/or a filling of packages. Alternatively or additionally, it is also conceivable that the transverse sealing device is rotatable, at least substantially as a whole, around the rotation axis of the transverse sealing device manually free from any addition mechanical control elements or the like. Additionally or alternatively, it is conceivable that the transverse sealing device is rotatable, at least substantially as a whole, when the vertical form fill sealing machine does not fill packages and/or seal packaging material.

Advantageously, a form fill sealing machine with a particularly space-saving structure can be provided. Advantageously, the transverse sealing device can be rotated in a particularly space-saving manner. Advantageously, the transverse sealing device is arranged particularly compactly, which enables particularly comfortable maintenance and/or replacement of the transverse sealing device. Due to the compact design a torque that can be generated by a rotation of the transverse sealing device can be kept particularly small. Advantageously, a particularly component-friendly rotation of the transverse sealing device can be achieved. A particularly quick-moving rotation of the transverse sealing device can be achieved. Advantageously a particularly low drive force is sufficient to generate a rotation of the transverse sealing device.

Moreover, it is proposed that a, in particular the already aforementioned, main extension axis of the at least substantially circular cylindrical receiving area is arranged within a proximity area of the rotation axis of the transverse sealing device. The proximity area of the rotation axis of the transverse sealing device preferably has a maximum extension starting from the rotation axis of the transverse sealing device, which is in particular oriented perpendicularly to the rotation axis of the transverse sealing device, whose value is maximally 20%, particularly preferable maximally 10%, of a value of a maximum transverse extent of the transverse sealing device. In particular, the maximum transverse extent of the transverse sealing device is oriented at least substantially perpendicularly to the vertical movement axis of the guide unit of the transverse sealing device, the rotation axis of the transverse sealing device and/or to the sealing surfaces of the at least two sealing jaws. Preferably the main extension axis of the at least substantially circular cylindrical receiving area is equivalent to the rotation axis of the transverse sealing device. Advantageously, a particularly space-saving rotation of the transverse sealing device and a compact design of the transverse sealing device can be achieved by the arrangement of the main extension axis of the at least substantially circular cylindrical receiving area in a proximity area of the rotation axis of the transverse sealing device.

Furthermore, it is proposed that the transverse sealing device comprises at least two, in particular the already aforementioned two, sealing jaws, wherein a, in particular the already aforementioned, main extension axis of the at least substantially circular cylindrical receiving area is located in a proximity area of a sealing plane of the at least two sealing jaws. The proximity area of the sealing plane preferably has a maximum extension starting from the sealing plane, which is in particular oriented perpendicularly to the sealing plane, whose value is maximally 20%, particularly preferable maximally 10%, of a value of the maximum transverse extent of the transverse sealing device. The sealing plane of the at least two sealing jaws is in particular defined by the sealing surfaces of the at least two sealing jaws in a position in which the sealing surfaces of the at least two sealing jaws are directly adjacent to each other, preferably in contact with each other. Particularly preferably, the main extension axis of the at least substantially circular cylindrical receiving area is located in the sealing plane of the at least two sealing jaws. In particular, the rotation axis is located in the sealing plane of the at least two sealing jaws. In particular, the rotation axis of the transverse sealing device intersects with a proximity area of a center point of the at least two sealing jaws relative to the sealing surfaces of the at least two sealing jaws, or goes through the center point of the sealing surfaces of the at least two sealing jaws. The proximity area of the center point preferably has a maximum extension starting from the center point whose value is maximally 20%, particularly preferably maximally 10%, of a value of a maximum transverse extent of the transverse sealing device. Advantageously the transverse sealing device can be rotated in a particularly space-saving manner. A particularly compact vertical form fill sealing machine with a rotatable transverse sealing device can be provided.

Moreover, it is proposed that the transverse sealing device has a central axis, which in particular intersects a center point of the transverse sealing device, wherein a, in particular the already aforementioned, main extension axis of the at least substantially circular cylindrical receiving area is arranged in a proximity area of the central axis of the transverse sealing device. In particular, the center point of the transverse sealing device is the geometric center of the transverse sealing device. Preferably, the central axis of the transverse sealing device is equivalent to a main extension axis of the transverse sealing device. In particular, the central axis of the transverse sealing device is equivalent to the rotation axis of the transverse sealing device. Alternatively, it is also conceivable that the central axis of the transverse sealing device is different from the rotation axis of the transverse sealing device. The proximity area of the central axis of the transverse sealing device preferably has a maximum extension starting from the central axis of the transverse sealing device, which is in particular oriented perpendicularly to the central axis of the transverse sealing device, whose value is maximally 20%, particularly preferable maximally 10%, of a value of a maximum transverse extent of the transverse sealing device. Advantageously, the transverse sealing device can be rotated in a particularly space-saving manner. A particularly compact vertical form fill sealing machine with a rotatable transverse sealing device can be provided. The transverse sealing device can be arranged on the machine frame in such a manner, that at least substantially all parts of the transverse sealing device are particularly easy to reach. Maintenance work and/or a replacement of parts of the transverse sealing device can be carried out particularly conveniently.

Furthermore, it is proposed that the guide element of the guide unit of the vertical form fill sealing machine defines a circle-shaped guideway, wherein the transverse sealing device is arranged at least substantially completely within a circular cylinder corresponding to the circle-shaped guideway. In particular in the preferred embodiment, the circular cylinder corresponding to the circle-shaped guideway differs, especially in a radius, from the circular cylindrical receiving area. Alternatively it is also conceivable that the circular cylinder corresponding to the circle-shaped guideway is equivalent to the circular cylindrical receiving area. In particular it is conceivable alternatively, that the circular cylindrical shaped receiving area is at least partially delimited by the circle-shaped guideway of the guide element. The circle shaped guideway is preferably defined by the guide rail, the guide groove or the like of the guide element of the guide unit of the vertical form fill sealing machine or by a circular line along which the plurality of guide elements is arranged. Advantageously, a particularly compact arrangement of the transverse sealing device can be realized. The transverse sealing device can be arranged on the machine frame in such a manner, that at least substantially all parts of the transverse sealing device are particularly easy to reach. Maintenance work and/or a replacement of parts of the transverse sealing device can be carried out particularly conveniently.

Moreover, it is proposed that the transverse sealing device has at least partially a circle-shaped outside contour, at least viewed in a direction parallel to the rotation axis. Preferably, the outside contour of the transverse sealing device constitutes a full circle, at least viewed in the direction parallel to the rotation axis. In particular, a curvature, preferably at least a curvature radius of the curvature, of the at least partially circle-shaped outside contour is equivalent to the curvature, preferably the radius of the curvature, of the at least one guide element of the guide unit of the vertical form fill sealing machine, in particular the inside wall of the guide element, and/or a curvature, in particular a curvature radius, of a circular line along which the plurality of guide elements of the guide unit of the vertical form fill sealing machine is arranged, preferably at least viewed in the direction parallel to the rotation axis. The at least partially circle-shaped outside contour is preferably arranged on a side of the transverse sealing device that faces the machine frame, in particular the inner wall of the machine frame. Preferably, the frame of the transverse sealing device constitutes the at least partially circle-shaped outside contour of the transverse sealing device. Alternatively, it is also conceivable, that at least one of the at least two sealing jaws or another component of the transverse sealing device constitute/s the at least partially circle-shaped outside contour of the transverse sealing device. It is conceivable, that the transverse sealing device has a circular cylindrical outside wall. Advantageously, a particularly precise and compact rotation of the transverse sealing device at least substantially as a whole can be realized.

Furthermore, it is proposed that the guide element of the guide unit of the vertical form fill sealing machine, in particular the inside wall of the guide element, encompasses the transverse sealing device in at least one rotational position of the transverse sealing device relative to the guide element of the guide unit of the vertical form fill sealing machine by at least 75° along a circumferential direction of the transverse sealing device. The circumferential direction of the transverse sealing device preferably runs in a plane which is perpendicular to the rotation axis of the transverse sealing device. It is conceivable that the guide element of the guide unit of the vertical form fill sealing machine, in particular the inside wall of the guide element encompasses the transverse sealing device in at least one further rotational position of the transverse sealing device relative to the guide element, by less than 270°, particularly preferably by less than 180° or alternatively by less than 75°, along the circumferential direction of the transverse sealing device. Preferably, the at least one guide element of the guide unit of the vertical form fill sealing machine encompasses the transverse sealing device in the at least one rotational position of the transverse sealing device relative to the guide element, by at least 90°. It is also conceivable that the at least one guide element of the guide unit of the vertical form fill sealing machine encompasses the transverse sealing device in the at least one rotational position of the transverse sealing device relative to the guide element by at least 180° and particularly preferably by 360° along the circumferential direction of the transverse sealing device. It is also conceivable that a maximum extension of an arrangement region of the plurality of guide elements of the guide unit of the vertical form fill sealing machine along the circular line encompasses the transverse sealing device in at least one rotational position of the transverse sealing device relative to the plurality of guide elements, by at least 75° along the circumferential direction of the transverse sealing device. It is also conceivable that the plurality of guide elements of the guide unit of the vertical form fill sealing machine is arranged along the circular line, wherein the maximum extension of the arrangement region of the plurality of guide elements of the guide unit of the vertical form fill sealing machine along the circular line encompasses the transverse sealing device in at least one further rotational position of the transverse sealing device relative to the plurality of guide elements, by less than 270°, particularly preferably by less than 180° or alternatively by less than 75°, along the circumferential direction of the transverse sealing device. It is conceivable, that the maximum extension of the arrangement region of the plurality of guide elements of the guide unit of the vertical form fill sealing machine along the circular line encompasses the transverse sealing device in the at least one rotational position of the transverse sealing device relative to the plurality of guide elements, by at least 90°, particularly preferably by at least 180° and especially preferentially by 360° along the circumferential direction of the transverse sealing device. Advantageously a particularly precise and secure rotation of the transverse sealing device substantially as a whole can be realized.

Moreover, it is proposed that the vertical form fill sealing machine comprises a filling station with at least one filling tube for filling a package with content, wherein a, in particular the already aforementioned, main extension axis of the at least substantially circular cylindrical receiving area is arranged within a proximity area of a central axis of the filling tube, and is in particular equivalent to the central axis of the filling tube. Preferably, the rotation axis is arranged in the proximity area of the central axis of the filling tube. It is also conceivable that the central axis of the filling tube is equivalent to a main extension axis of the filling tube. The central axis of the filling tube is particularly preferably equivalent to a main output axis of the filling tube. The proximity area of the central axis of the filling tube preferably has a maximum extension starting from the central axis of the filling tube, which is in particular oriented perpendicularly to the central axis of the filling tube, whose value is maximally 20%, particularly preferably maximally 10%, of a value of the maximum transverse extent of the transverse sealing device. In particular, the central axis of the filling tube runs at least substantially parallel to the rotation axis of the transverse sealing device and/or the main extension axis of the at least substantially circular cylindrical receiving area. Preferably, the filling station is arranged in such a way that the vertical movement axis of the guide unit of the transverse sealing device intersects with the filling station. In particular, the central axis of the filling tube runs at least substantially parallel to the vertical movement axis of the guide unit of the transverse sealing device and/or the sealing surfaces of the at least two sealing jaws. Advantageously a particularly compact form fill sealing machine can be provided. Advantageously a package can be filled during a particularly space-saving rotation of the transverse sealing device relative to the filling tube.

Beyond this it is proposed that the guide element of the guide unit of the vertical form fill sealing machine has a, in particular the already aforementioned, guide groove with an undercut. Preferably at least in the preferred embodiment, the at least one further guide element of the guide unit of the vertical form fill sealing machine is implemented in such a way, that the further guide element engages in the undercut of the guide groove. Alternatively it is also conceivable, that the guide groove of the guide element of the guide unit of the vertical form fill sealing machine is implemented free from an undercut. Advantageously, a particularly safe connection between the transverse sealing the device and the machine frame can be realized. Advantageously, a guide element can be provided by means of which an unintentional release of an element from the guide rail can be counteracted particularly efficiently and simply.

Furthermore, a method for operating a vertical form fill sealing machine, in particular the vertical form fill sealing machine according to the invention, is proposed, wherein at least two sealing jaws, in particular the aforementioned two sealing jaws, of a, in particular the aforementioned, transverse sealing device of the vertical form fill sealing machine are moved along a vertical movement axis of a, in particular the aforementioned, guide unit of the transverse sealing device via a, in particular the aforementioned, movement unit of the transverse sealing device, wherein the transverse sealing device is at least substantially completely arranged in an at least substantially circular cylindrical receiving area delimited at least partially by an, in particular the aforementioned, at least one guide element of the guide unit. Preferably in one process step a, in particular the already aforementioned, transverse sealing device of the vertical form fill sealing machine is rotated at least substantially as a whole around an, in particular the already aforementioned, rotation axis of the transverse sealing device relative to an, in particular the already aforementioned, machine frame of the vertical form fill sealing machine. It is conceivable that in one process step the transverse sealing device is rotated substantially as a whole during a sealing of the packaging material and/or a filling of packages, preferably by means of the drive unit of the vertical form fill sealing machine and/or manually by the at least one mechanical control element. It is also conceivable that in one process step the transverse sealing device is rotated at least substantially as a whole when the vertical form fill sealing machine is does not fill packages and/or seal packaging material, preferably by means of the drive unit of the vertical form fill sealing machine and/or manually by the at least one mechanical control element. Preferably, in one process step the transverse sealing device is rotated at least substantially as a whole through an angle of 90° around the rotation axis of the transverse sealing device relative to the machine frame. Alternatively, it is also conceivable that in one process step the transverse sealing device is rotated at least substantially as a whole around the rotation axis of the transverse sealing device through an angle other than 90° relative to the machine frame. In particular in one process step the transverse sealing device is steplessly rotated, substantially as a whole, around the rotation axis from one work position of the transverse sealing device for a transverse sealing of a packaging material to a further work position of the transverse sealing device for a transverse sealing of a packaging material. In particular, in one process step the transverse sealing device is rotated at least substantially as a whole around the rotation axis of the transverse sealing device that is positionally fixed relative to the machine frame of the vertical form fill sealing machine from the one work position of the transverse sealing device for a transverse sealing of a packaging material to the further work position of the transverse sealing device for a transverse sealing of a packaging material. Particularly preferably, in one process step the transverse sealing device is rotated substantially as a whole around the rotation axis of the transverse sealing device, in particular by means of the drive unit of the vertical form fill sealing machine and/or manually by means of the at least one mechanical control element, from the work position to the further work position free from any translational movement of the transverse sealing device relative to the machine frame. Advantageously a particularly fast, easy and space-saving rotation of the transverse sealing device, at least substantially as a whole, relative to the machine frame can be realized. Advantageously, a particularly flexible operation of a transverse sealing device can be realized.

The vertical form fill sealing machine according to the invention and/or the method according to the invention shall herein not be limited to the application and implementation described above. In particular, in order to fulfill a functionality that is described here, the vertical form fill sealing machine according to the invention and/or the method according to the invention may comprise a number of individual elements, components and units as well as method steps that differs from a number given here. Moreover, concerning the value ranges given in the present disclosure, values within the limits mentioned shall also be considered to be disclosed and to be usable as applicable.

BRIEF DESCRIPTION OF THE DRAWINGS

Further advantages will become apparent from the following description of the drawing. In the drawing seven exemplary embodiments of the invention are illustrated. The drawing, the description and the claims contain a plurality of features in combination. Someone skilled in the art will purposefully also consider the features individually and will find further expedient combinations.

It is shown in.

DETAILED DESCRIPTION

Figure 1:
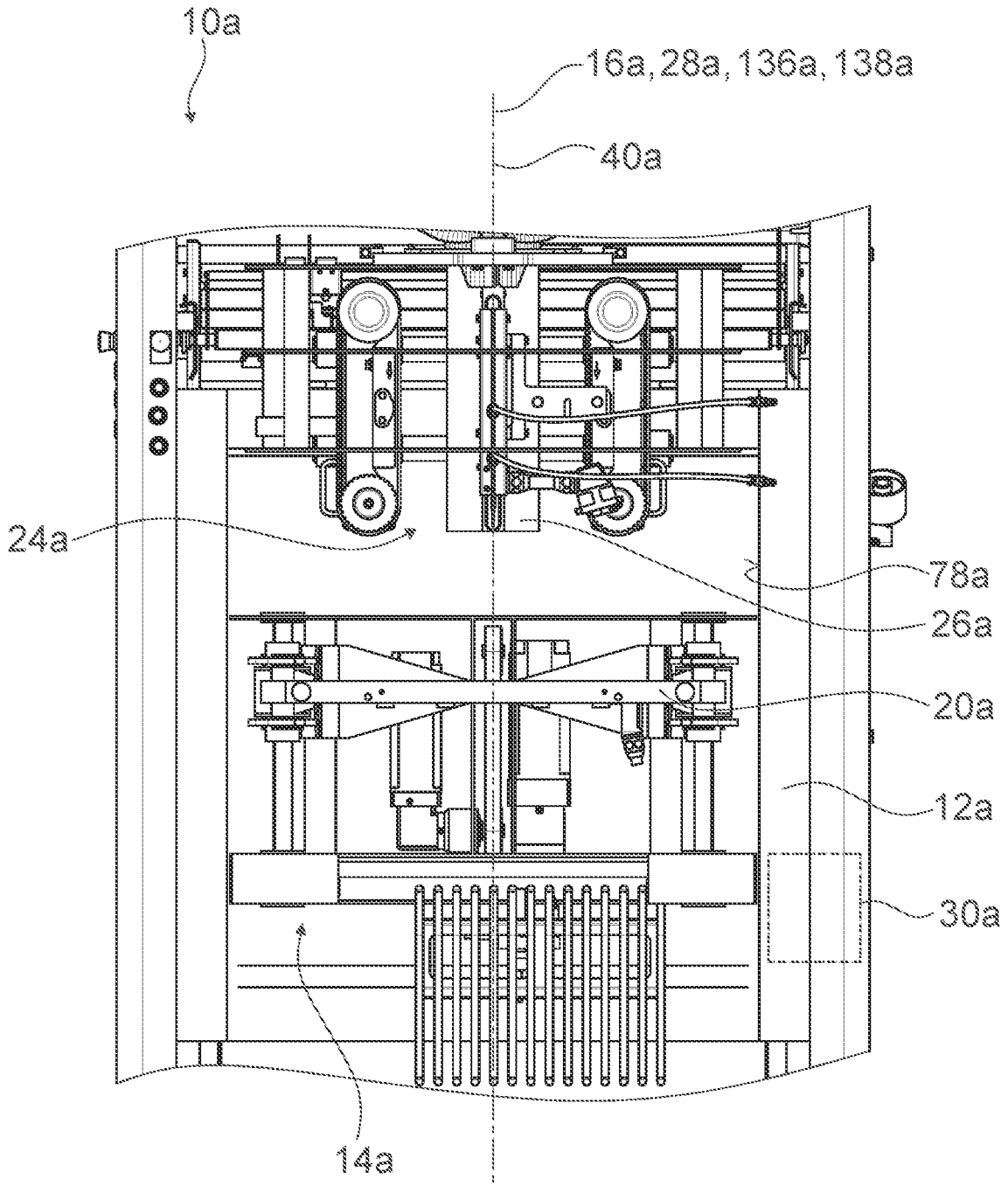
FIG. 1A section of a vertical form fill sealing machine according to the invention with a transverse sealing device according to the invention, in a schematic representation, FIG. 2A section of the vertical form fill sealing machine according to the invention, in another schematic representation, FIG. 3 the transverse sealing device according to the invention, in a detailed schematic representation, FIG. 4 a schematic flow chart of a method for operating the form fill sealing machine according to the invention, FIG. 5 a schematic flow chart of a method for operating the transverse sealing device according to the invention, FIG. 6 a transverse sealing device according to the invention in a first alternative embodiment, FIG. 7 a transverse sealing device according to the invention in a second alternative embodiment, FIG. 8 a schematic flow chart of a method for operating the transverse sealing device according to the invention in the second alternative embodiment, FIG. 9*a* a movement diagram for a vertical movement of at least two sealing jaws of the transverse sealing device according to the invention in the second alternative embodiment, FIG. 9*b* a movement diagram for a horizontal movement of the at least two sealing jaws of the transverse sealing device according to the invention in the second alternative embodiment, FIG. 10 a transverse sealing device according to the invention in a third alternative embodiment, FIG. 11 a transverse sealing device according to the invention in a fourth alternative embodiment, FIG. 12 a transverse sealing device according to the invention in a fifth alternative embodiment, and FIG. 13 a transverse sealing device in a sixth alternative embodiment.

In FIG. 1 a vertical form fill sealing machine 10*a* is shown. The vertical form fill sealing machine 10*a* comprises a machine frame 12*a*. The vertical form fill sealing machine 10*a* comprises at least one transverse sealing device 14*a* for a transverse sealing of a packaging material. The vertical form fill sealing machine 10*a* comprises at least one supply station (not shown here) having components configured for holding a roll of packaging material. The vertical form fill sealing machine comprises a form shoulder (not shown here) for transforming the packaging material into a tube. The vertical form fill sealing machine comprises a longitudinal sealing device (not shown here) for a longitudinal sealing of the packaging material. The vertical form fill sealing machine 10*a* comprises a filling station 24*a*. The filling station 24*a* comprises at least one filling tube 26*a* that is configured to fill a package with content. The filing station 24*a*, the supply station, the transverse sealing device 14*a* and/or the longitudinal sealing device are attached to the machine frame 12*a* of the vertical form fill sealing machine 10*a*.

The transverse sealing device 14*a* is mounted on the machine frame 12*a* so that it can be rotated around a rotation axis 16*a* of the transverse sealing device 14*a* at least substantially as a whole. At least substantially all components of the transverse sealing device 14*a* are simultaneously rotatable around the rotation axis 16*a* of the transverse sealing device 14*a*, in particular relative to the machine frame 12*a*. The transverse sealing device 14*a* comprises a frame 70*a*. All components of the transverse sealing device 14*a* other than the frame 70*a* are mounted on the frame 70*a* of the transverse sealing device 14*a*. The frame 70*a* of the transverse sealing device 14*a* is arranged movably, preferably rotatably, on the machine frame 12*a*.

The transverse sealing device 14*a* is mounted movably, in particular rotatably, on the machine frame 12*a* in such a way that the rotation axis 16*a* of the transverse sealing device 14*a* is positionally fixed relative to the machine frame 12*a*, in particular independently from any operational movements of the transverse sealing device 14*a* relative to the machine frame 12*a*. The transverse sealing device 14*a* is mounted on the machine frame 12*a* in such a way that the transverse sealing device 14*a* is only movable at least substantially as a whole by a rotation of the transverse sealing device 14*a* substantially as a whole around the rotation axis 16*a* of the transverse sealing device 14*a*. A rotation of the transverse sealing device 14*a* substantially as a whole relative to the machine frame 12*a* is generatable free from any translational movements of the transverse sealing device 14*a* at least substantially as a whole, in particular relative to the machine frame 12*a*. The transverse sealing device 14*a* is mounted on the machine frame 12*a* in such a way that the transverse sealing device 14*a*, substantially as a whole, has only one degree of freedom to move. Alternatively, it is also conceivable that the transverse sealing device 14*a* is mounted on the machine frame 12*a* in such a way that the transverse sealing device 14*a* can be moved translationally, in particular along a direction parallel to a translational movement axis of a guide unit 82*a* of the transverse sealing device 14*a*, in particular relative to the machine frame 12*a*. The rotation axis 16*a* of the transverse sealing device 14*a* runs at least substantially perpendicularly to a support surface of the machine frame 12*a*. The support surface of the machine frame 12*a* is configured to transmit weight forces of the vertical form fill sealing machine 10*a*, in particular the machine frame 12*a*, to a floor, on which the vertical form fill sealing machine 10*a* is arranged. The support surface of the machine frame 12*a* is in particular part of a stand of the machine frame 12*a*, of a bottom surface of the machine frame 12*a* or the like.

The transverse sealing device 14*a* is positionable in at least two work positions for a transverse sealing of a packaging material by means of a stepless rotation of the transverse sealing device 14*a* relative to the machine frame 12*a* around the rotation axis 16*a*. Preferably the stepless rotation of the transverse sealing device 14*a*, at least substantially as a whole, relative to the machine frame 12*a* around the rotation axis 16*a* is a pure rotation, particularly preferably free from any translational movements of the transverse sealing device 14*a* relative to the machine frame 12*a*, in particular from one work position of the at least two work positions to a further work position of the at least two work positions. The transverse sealing device 14*a* is mounted on the machine frame 12*a* in such a way that the transverse sealing device 14*a* can be positioned in at least two work positions for a transverse sealing of a packaging material free of any translational movement of the transverse sealing device 14*a* at least substantially as a whole, in particular relative to the machine frame 12*a*. The transverse sealing device 14*a* is positionable in the at least two work positions for a transverse sealing of a packaging material solely by means of the rotation of the transverse sealing device 14*a*, at least substantially as a whole, relative to the machine frame 12*a*, in particular free from any additional, especially linearly guided, movements of the transverse sealing device 14*a* at least substantially as a whole relative to the machine frame 12*a*. The at least two work positions of the transverse sealing device 14*a* differ in a rotational position of the transverse sealing device 14*a*, in particular at least substantially as a whole, relative to the machine frame 12*a*. The at least two work positions of the transverse sealing device 14*a* differ from each other by an angle of 90°. Alternatively, it is also conceivable that the at least two work positions of the transverse sealing device 14*a* differ from each other by an angle different from 90°, preferably by an angle greater than 0° and less than 360°. It is also conceivable that the transverse sealing device 14*a* can be rotated over 360°, in particular by an integer or a non-integer multiple of 360°, relative to the machine frame 12*a*. It is conceivable that energy supply lines of the vertical form fill sealing machine 10*a* for supplying the transverse sealing device 14*a* with energy are implemented and/or arranged relative to the machine frame 12*a* and/or the transverse sealing device 14*a* such as to enable a 360° rotation, preferably a rotation over 360°, in particular a rotation by an integer or a non-integer multiple of 360°, of the transverse sealing device 14*a* relative to the machine frame 12*a*. Exemplarily the energy supply lines are arranged in combination with a slip ring, a rotary transformer or the like of the vertical form fill sealing machine 10*a* such as to enable a 360° rotation of the transverse sealing device 14*a* relative to the machine frame 12*a*. It is conceivable that the transverse sealing device 14*a* is infinitely rotatable at least substantially as a whole around the rotation axis 16*a* in a variety of different work positions for a transverse sealing of a packaging material. Alternatively, it is also conceivable that the transverse sealing device 14*a* is rotatable at least substantially as a whole around the rotation axis 16*a* of the transverse sealing device 14*a* into fixed, in particular spaced-apart, rotational positions of the transverse sealing device 14*a* relative to the machine frame 12*a*, which in particular constitute different work positions of the transverse sealing device 14*a*.

Figure 2:
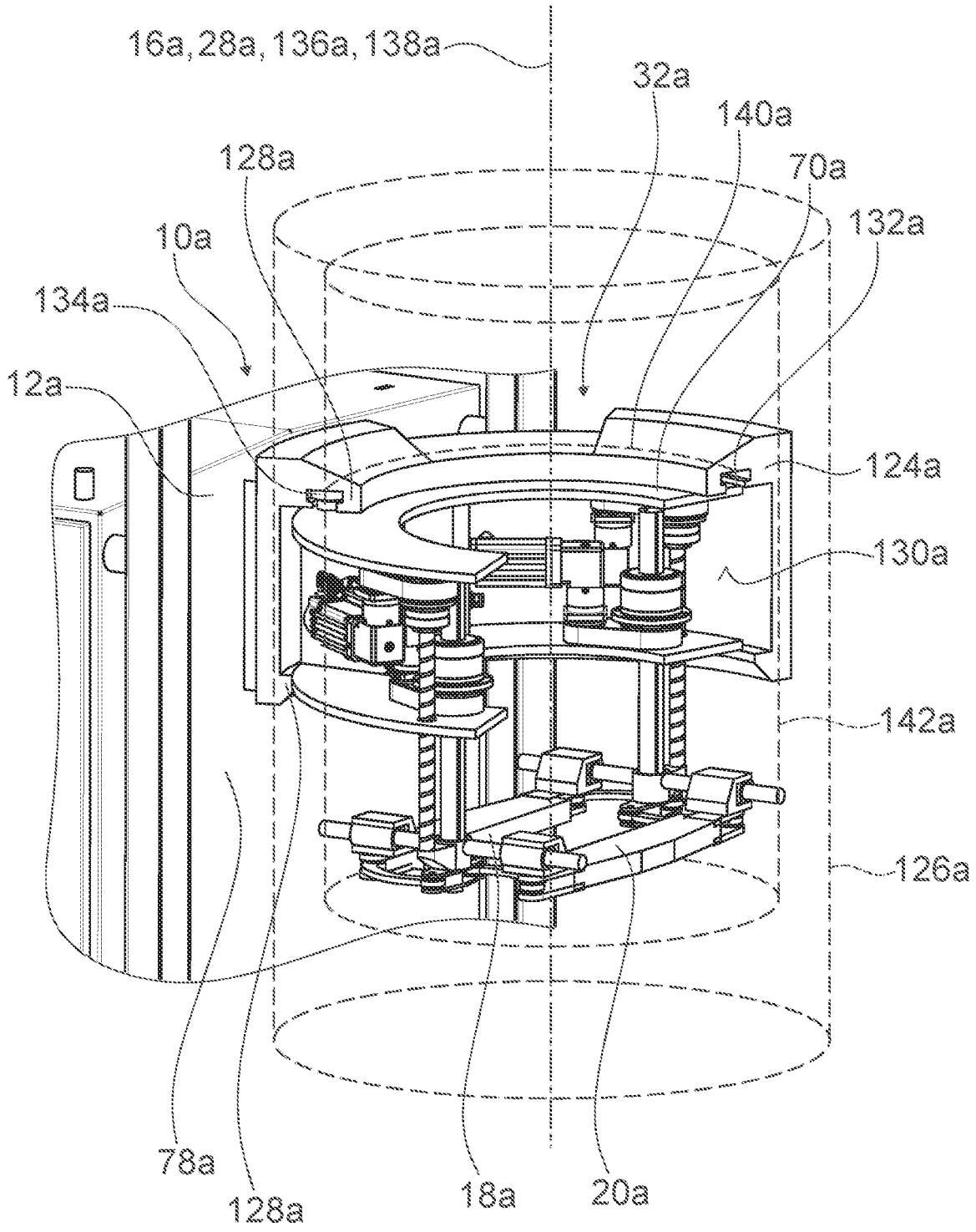
Figure 3:
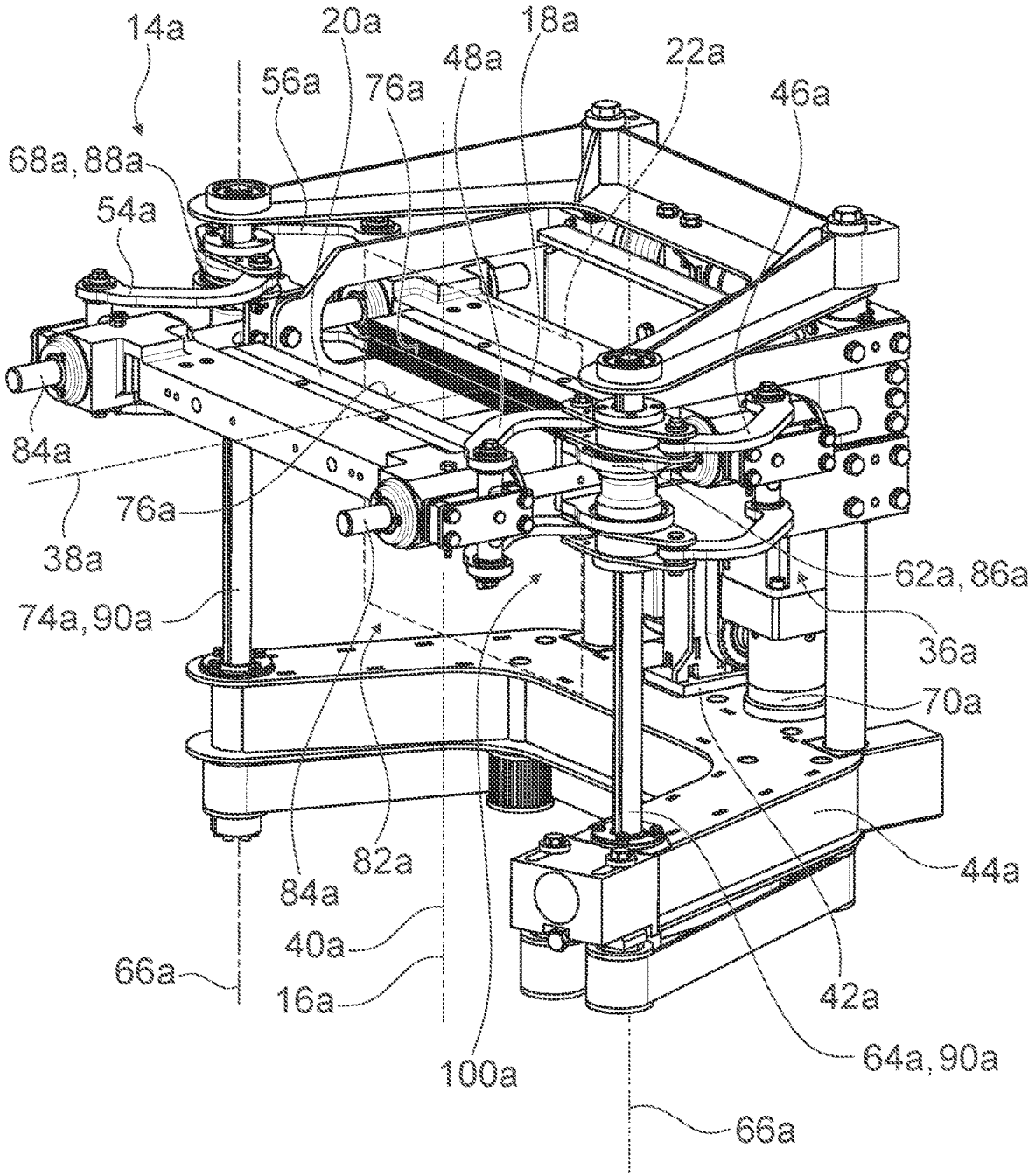

FIG. 2 shows a schematic structure of the transverse sealing device that is at least partially different form an actual implementation of the transverse sealing device 14*a*, which is shown in FIG. 3. However, FIG. 2 illustrates the interaction of a guide unit 32*a* of the vertical form fill sealing machine 10*a* with the transverse sealing device 14*a*. The guide unit 32*a* of the vertical form fill sealing machine 10*a* is intended to guide the rotation of the transverse sealing device 14*a* around the rotation axis 16*a* at least substantially as a whole. The guide unit 32*a* of the vertical form fill sealing machine 10*a* comprises at least one guide element 124*a*. The at least one guide element 124*a* delimits at least partially an at least substantially circular cylindrical receiving area 126*a* within which the transverse sealing device 14*a* is at least substantially completely arranged. The term "substantially completely" is here in particular to mean at least 50%, preferably 75% and particularly preferably at least 90% of a total volume of an object, preferably of a total volume of a circular cylinder that just completely encloses the object, and/or a total mass of the object, in particular of the transverse sealing device. The guide unit 32*a* of the vertical form fill sealing machine 10*a* is at least partially arranged on the machine frame 12*a*.

The at least one guide element 124*a* is arranged on the machine frame 12*a*. The at least one guide element 124*a* is implemented integrally with the machine frame 12*a*. "Implemented integrally" is in particular to mean connected at least by substance-to-substance bond, for example by a welding process, a gluing process, an injection-molding process, and/or another process that is deemed expedient by someone skilled in the art, and/or advantageously formed in one piece, like for example by a production from a cast and/or by a production in a one-component or multi-component injection-molding procedure, and advantageously from a single blank. Alternatively, it is also conceivable that the guide element 124*a* is arranged in a detachable, in particular a non-destructive, manner on the machine frame 12*a*. The at least one guide element 124*a* is circle-shaped, at least viewed in a direction parallel to the rotation axis 16*a* of the transverse sealing device 14*a*. The at least one guide element 124*a* has an annulus-form, particularly preferable an annulus-segment-form, at least viewed in the direction parallel to the rotation axis 16*a* of the transverse sealing device 14*a*. The at least one guide element 124*a* has a hollow-cylinder form, wherein the guide element 124*a* has at each end of the hollow-cylinder-formed guide element 124*a* a protrusion 128*a*, in particular on an inside wall 130*a* of the guide element 124*a*. The inside wall 130*a* is circular-cylinder-shaped, in particular except from the protrusions 128*a*. At least part of the transverse sealing device 14*a* is arranged between the protrusions 128*a* of the guide element 124*a*, preferably in contact with the protrusions 128*a*. The at least one guide element 124*a* has a guide groove 132*a*. The guide groove 132*a* is arranged on one of the protrusions 132*a* of the guide element 124*a*. Alternatively or additionally, it is also conceivable that the guide element 124*a* has at least one guide knob, at least one guide stud or the like. Furthermore, it is also conceivable alternatively that the guide element 124*a* is implemented as a guide rail, a guide groove, a guide knob, a guide stud or the like. Alternatively, it is also conceivable that the guide unit 32*a* of the vertical form fill sealing machine 10*a* comprises a plurality of guide elements 124*a*, which are arranged in a circular manner. The guide groove 132*a* has an undercut. Alternatively it is also conceivable, that the guide groove 132*a* of the guide element 124*a* is implemented free from an undercut.

It is conceivable that the at least one guide element 124*a* has a plurality of snap-in points, in particular spaced-apart from each other, along a guide direction of the at least one guide element 124*a*, wherein the transverse sealing device 14*a* can be snapped in at the snap-in points. Alternatively, it is also conceivable that the at least one guide element 124*a* is free from any snap-in points. Preferably, the transverse sealing device 14*a* can be fixed steplessly along the at least one guide element 124*a*, e.g. via a clamping connection or the like. The at least one guide element 124*a* is arranged on an inner wall 78*a* of the machine frame 12*a*. The at least one guide element is implemented integrally with the inner wall 78*a* of the machine frame 12*a*. Alternatively it is also conceivable, that the at least one guide element 124*a* of the guide unit 32*a* of the vertical form fill sealing machine 10*a* is arranged detachably on the inner wall 78*a* of the machine frame 12*a*, in particular in a non-destructive manner. The inner wall 78*a* of the machine frame 12*a* is arranged on a side of the machine frame 12*a* that faces towards the transverse sealing device 14*a*. The inner wall 78*a* is plane. Alternatively, it is also conceivable that the inner wall 78*a* is at least partially circular cylindrical shaped or has a polygonal shape, at least viewed in the direction parallel to the rotation axis 16*a*.

The guide unit 32*a* of the vertical form fill sealing machine 10*a* comprises at least one further guide element 134*a*, which is arranged on the transverse sealing device 14*a*. The at least one further guide element 134*a* is implemented as a guide knob. The at least one further guide element 134*a* is implemented in such a way, that the further guide element 134*a* engages in the undercut of the guide groove 132*a*. Alternatively it is also conceivable that the at least one further guide element 134*a* is implemented as a guide rail, a guide groove, a guide stud or the like. It is also conceivable that the guide unit 32*a* of the vertical form fill sealing machine 10*a* comprises a plurality of further guide elements 134*a*, which are arranged on the transverse sealing device 14*a*. The at least one further guide element 134*a* is implemented correspondingly to the at least one guide element 124*a*. The at least one further guide element 134*a* is arranged on a bottom side or a top side of the transverse sealing device 14*a*, at least viewed in the direction parallel to the rotation axis 16*a*. Alternatively it is also conceivable that the at least one further guide element 134*a* is arranged laterally to the transverse sealing device 14*a*, at least viewed in the direction parallel to the rotation axis 16*a*. The at least one further guide element 134*a* is implemented integrally with the transverse sealing device 14*a*. Alternatively it is also conceivable, that the at least one further guide element 134*a* of the guide unit 32*a* of the vertical form fill sealing machine 10*a* is arranged detachably on the transverse sealing device 14*a*, in particular in a non-destructive manner.

It is conceivable that the guide unit 32*a* of the vertical form fill sealing machine 10*a* and/or the machine frame 12*a* have/has one or more bearing points, in which the transverse sealing device 14*a*, in particular the frame 70*a* of the transverse sealing device 14*a*, is movably connected to the guide unit 32*a* of the vertical form fill sealing machine 10*a* and/or to the machine frame 12*a*. At least one bearing point is arranged on the bottom side or the top side of the transverse sealing device 14*a*, at least viewed in the direction parallel to the rotation axis 16*a*, preferably on at least one of the protrusions 128*a* of the guide element 124*a*. It is also conceivable alternatively that at least one bearing point is located laterally to the transverse sealing device 124*a*. Alternatively or additionally, at least one bearing point is located centrally relative to the transverse sealing device 14*a* on the bottom side or the top side of the transverse sealing device 14*a*, at least viewed in the direction parallel to the rotation axis 16*a*, in particular in such a way that the rotation axis 16*a* of the transverse sealing device 14*a* goes through the at least one bearing point.

The circular cylindrical shaped receiving area 126*a* is at least partially delimited by the inside wall 130*a* of the guide element 124*a*. The protrusions 128*a* of the guide element 124*a* protrude into the cylindrical shaped receiving area 126*a*. A curvature, in particular a curvature radius of the curvature, of the at least one guide element 124*a*, in particular of the inside wall 130*a* of the guide element 124*a*, is equivalent to a curvature, in particular a curvature radius of the curvature, of the at least substantially circular cylindrical receiving area 126*a*. The at least substantially circular cylindrical receiving area 126*a* is encompassed along a circumferential direction of the at least substantially circular cylindrical receiving area 126*a* by the at least one guide element 124*a*, in particular the inside wall 130*a* of the guide element 124*a*, by at least 75°, preferably by at least 90°. The circumferential direction of the at least substantially circular cylindrical receiving area 126*a* runs in a plane which is perpendicular to a main extension axis 136*a* of the at least substantially circular cylindrical receiving area 126*a*. By a "main extension axis" of an object or an area is herein in particular an axis to be understood which extends parallel to a longest edge of a smallest geometric rectangular cuboid that just still completely encloses the object or the area respectively. It is also conceivable alternatively, that the at least substantially circular cylindrical receiving area 126*a* is encompassed by the at least one guide element 124*a*, in particular the inside wall 130*a* of the guide element 124*a*, along the circumferential direction of the at least substantially circular cylindrical receiving area 126*a* by at least 135° and preferably by at least 180°. Alternatively, it is also conceivable, that the at least substantially circular cylindrical receiving area 126*a* is encompassed by the at least one guide element 124*a*, in particular the inside wall 130*a* of the at least one guide element 124*a*, along the circumferential direction of the at least substantially circular cylindrical receiving area 126*a* by the at least one guide element 124*a* by less than 75°.

The main extension axis 136*a* of the at least substantially circular cylindrical receiving area 124*a* is arranged within a proximity area of the rotations axis 16*a* of the transverse sealing device 14*a*. The proximity area of the rotation axis 16*a* of the transverse sealing device 14*a* has a maximum extension starting from the rotation axis 16*a* of the transverse sealing device 14*a*, which is in particular oriented perpendicularly to the rotation axis of the transverse sealing device, whose value is maximally 20%, particularly preferable maximally 10%, of a value of a maximum transverse extent of the transverse sealing device 14*a*. The maximum transverse extent of the transverse sealing device 14*a* is oriented at least substantially perpendicularly to the vertical movement axis 40*a* of the guide unit 82*a* of the transverse sealing device 14*a* and/or to the rotation axis 16*a* of the transverse sealing device 14*a*. The main extension axis 136*a* of the at least substantially circular cylindrical receiving area 124*a* is equivalent to the rotation axis 16*a* of the transverse sealing device 14*a*.

The transverse sealing device 14*a* comprises at least two sealing jaws 18*a*, 20*a*. Each of the at least two sealing jaws 18*a*, 20*a* has a sealing surface 76*a*. The sealing surfaces 76*a* of the at least two sealing jaws 18*a*, 20*a* are arranged facing each other. The sealing surfaces 76*a* of the at least two sealing jaws 18*a*, 20*a* are in contact with the packaging material in the sealing position in order to create a sealing in the packaging material. The sealing surfaces 76*a* of the at least two sealing jaws 18*a*, 20*a* run at least substantially parallel to each other. The main extension axis 136*a* of the at least substantially circular cylindrical receiving area 124*a* is located in a proximity area of a sealing plane 22*a* of the at least two sealing jaws 18*a*, 20*a*. The rotation axis 16*a* is located in the sealing plane 22*a* of the at least two sealing jaws 18*a*, 20*a*. The sealing plane 22*a* of the at least two sealing jaws 18*a*, 20*a* is in particular defined by the sealing surfaces 76*a* of the at least two sealing jaws 18*a*, 20*a* in a position in which the sealing surfaces 76*a* of the at least two sealing jaws 18*a*, 20*a* are directly adjacent to each other, preferably in contact with each other. The proximity area of the sealing plane 22*a* has a maximum extension starting from the sealing plane 22*a*, which is in particular oriented perpendicularly to the sealing plane 22*a*, whose value is maximally 20%, particularly preferably maximally 10%, of a value of the maximum transverse extent of the transverse sealing device 14*a*. The main extension axis 136*a* of the at least substantially circular cylindrical receiving area 124*a* is located in the sealing plane 22*a* of the at least two sealing jaws 18*a*, 20*a*. The rotation axis 16*a* of the transverse sealing device 14*a* intersects with a proximity area of a center point of the at least two sealing jaws 18*a*, 20*a* relative to the sealing surfaces 76*a* of the at least two sealing jaws 18*a*, 20*a* or goes through the center point of the sealing area of the sealing surfaces 76*a* of the at least two sealing jaws 18*a*, 20*a*. The proximity area of the center point preferably has a maximum extension starting from the center point, whose value is maximally 20% of a value of a maximum transverse extent of the transverse sealing device 14*a*. In particular, the maximum transverse extent of the transverse sealing device 14*a* runs at least substantially perpendicularly to the vertical movement axis 40*a* of the guide unit 82*a* of the transverse sealing device 14*a* and/or to the sealing surfaces 76*a* of the at least two sealing jaws 18*a*, 20*a*.

The transverse sealing device 14*a* has a central axis 138*a*, which in particular intersects a center point of the transverse sealing device 14*a*. The main extension axis 136*a* of the at least substantially circular cylindrical receiving area 124*a* is arranged in a proximity area of the central axis 138*a* of the transverse sealing device 14*a*. The center point of the transverse sealing device 14*a* is the geometric center of the transverse sealing device 14*a*. The central axis 138*a* of the transverse sealing device 14*a* is equivalent to a main extension axis of the transverse sealing device 14*a*. The central axis 138*a* of the transverse sealing device 14*a* is equivalent to the rotation axis 16*a* of the transverse sealing device 14*a*. Alternatively, it is also conceivable that the central axis 138*a* of the transverse sealing device 14*a* is different from the rotation axis 16*a* of the transverse sealing device 14*a*. The proximity area of the central axis 138*a* of the transverse sealing device 14*a* has a maximum extension starting from the central axis 138*a* of the transverse sealing device 14*a*, which is in particular oriented perpendicularly to the central axis 138*a* of the transverse sealing device 14*a*, whose value is maximally 20%, particularly preferably maximally 10%, of a value of a maximum transverse extent of the transverse sealing device 14*a*.

The guide element 124*a* of the guide unit 32*a* of the vertical form fill sealing machine 10*a* defines a circle-shaped guideway 140*a*, wherein the transverse sealing device 14*a* is arranged at least substantially completely within a circular cylinder 142*a* corresponding to the circle-shaped guideway 140*a*. The circular cylinder 142*a* corresponding to the circle-shaped guideway 140*a* differs, especially in a radius, from the circular cylindrical receiving area 126*a*. The circle shaped guideway 140*a* is defined by the guide groove 132*a* of the guide element 124*a*. Alternatively it is also conceivable that the circular cylinder 142*a* corresponding to the circle-shaped guideway 140*a* is equivalent to the circular cylindrical receiving area 126*a*. In particular it is conceivable alternatively, that the circular cylindrical shaped receiving area 126*a* is at least partially delimited by the circle-shaped guideway 140*a* of the guide element 124*a*.

The transverse sealing device 14*a* has at least partially a circle-shaped outside contour, at least viewed in a direction parallel to the rotation axis 16*a*. The outside contour 16*a* of the transverse sealing device 14*a* constitutes a full circle, at least viewed in the direction parallel to the rotation axis 16*a*. A curvature, preferably at least a curvature radius of the curvature, of the at least partially circle-shaped outside contour is equivalent to the curvature, preferably the radius of the curvature, of the at least one guide element 124*a*, in particular the inside wall 130*a* of the guide element 124*a*, preferably at least viewed in the direction parallel to the rotation axis 16*a*. The at least partially circle-shaped outside contour is arranged on a side of the transverse sealing device 14*a* that faces the machine frame 12*a*, in particular the inner wall 78*a* of the machine frame 12*a*. The frame 70*a* of the transverse sealing device 14*a* constitutes the at least partially circle-shaped outside contour of the transverse sealing device 14*a*. Alternatively, it is also conceivable, that at least one of the at least two sealing jaws 18*a*, 20*a* or another component of the transverse sealing device 14*a* constitute/s the at least partially circle-shaped outside contour of the transverse sealing device 14*a*. It is also conceivable, that the transverse sealing device 14*a* has a circular cylindrical outside wall.

The guide element 124*a*, in particular the inside wall 130*a* of the guide element 124*a*, encompasses the transverse sealing device 14*a* in at least one rotational position of the transverse sealing device 14*a* relative to the guide element 124*a* by at least 75° along a circumferential direction of the transverse sealing device 14*a*. The circumferential direction of the transverse sealing device 14*a* runs in a plane which is perpendicular to the rotation axis 16*a* of the transverse sealing device 14*a*. Alternatively, it is conceivable that the guide element 124*a*, in particular the inside wall 130*a* of the guide element 124*a* encompasses the transverse sealing device 14*a* in at least one further rotational position of the transverse sealing device 14*a* relative to the guide element 124*a*, by less than 75° along the circumferential direction of the transverse sealing device 14*a*. Preferably, the at least one guide element 124*a* encompasses the transverse sealing device 14*a* in the at least one rotational position of the transverse sealing device 14*a* relative to the guide element 124*a*, by at least 90°. It is also conceivable that the at least one guide element 124*a* encompasses the transverse sealing device 14*a* in the at least one rotational position of the transverse sealing device 14*a* relative to the guide element 124*a* by at least 180° and particularly preferably by 360° along the circumferential direction of the transverse sealing device 14*a*.

The main extension axis 136*a* of the at least substantially circular cylindrical receiving area 126*a* is arranged within a proximity area of a central axis 28*a* of the filling tube 26*a*, and is in particular equivalent to the central axis 28*a* of the filling tube 26*a*. The rotation axis 16*a* of the transverse sealing device 14*a* is arranged within the proximity area of the central axis 28*a* of the filling tube 26*a*, and is in particular equivalent to the central axis 28*a* of the filling tube 26*a*. The central axis 28*a* of the filling tube 26*a* is equivalent to a main output axis of the filling tube 26*a*. It is also conceivable that the central axis 28*a* of the filling tube 26*a* is equivalent to a main extension axis of the filling tube. The proximity area of the central axis 28*a* of the filling tube 26*a* has a maximum extension starting from the central axis 28*a* of the filling tube 26*a*, in particular running perpendicularly to the central axis 28*a* of the filling tube 26*a*, whose value is maximally 20%, particularly preferably maximally 10%, of a value of the maximum transverse extent of the transverse sealing device 14*a*. The central axis 28*a* of the filling tube 26*a* runs at least substantially parallel to the rotation axis 16*a* of the transverse sealing device 14*a* and/or the main extension axis 136*a* of the at least substantially circular cylindrical receiving area 126*a*. The filling station 24*a* is arranged in such a way that the vertical movement axis 40*a* of the guide unit 82*a* of the transverse sealing device 14*a*, intersects with the filling station 24*a*. The central axis 28*a* of the filling tube 24*a* runs at least substantially parallel to the vertical movement axis 40*a* of the guide unit 82*a* of the transverse sealing device 14*a*, and/or the sealing surfaces 76*a* of the at least two sealing jaws 18*a*, 20*a*.

The vertical form fill sealing machine 10*a* comprises a drive unit 30*a* to drive the movement unit so as to generate a rotation of the transverse sealing device 14*a* at least substantially as a whole around the rotation axis 16*a*. Exemplarily, the drive unit 30*a* of the vertical form fill sealing machine 10*a* is implemented as an electromotor, as a pneumatic motor or as another drive unit that appears reasonable to a person skilled in the art. The vertical form fill sealing machine 10*a* comprises a control unit (not shown here) to control a drive of the drive unit 30*a* of the vertical form fill sealing machine 10*a*. The control unit comprises at least a processor and a storage element as well as an operation program stored on the storage element. The storage element is preferably implemented as a digital storage element, for example as a hard disk or the like. The control unit controls the drive of the drive unit 30*a* of the vertical form fill sealing machine 10*a* automatically, in particular depending on a running operation program of the control unit. Alternatively or additionally, it is conceivable that the vertical form fill sealing device 10*a* comprises an input unit (not shown here) to manually control the drive unit 30*a* of the vertical form fill sealing machine 10*a* for rotating the transverse sealing device 14*a* at least substantially as a whole around the rotation axis 16*a*. Exemplarily, the input unit comprises a keyboard, a touchscreen, buttons, an adjustment wheel or the like. It is conceivable that the input unit is attached to the machine frame 12*a* or is part of an external unit such as a server, a smartphone, a laptop, a remote control or the like, which in particular has a data connection to the control unit of the vertical form fill sealing machine 10*a*. Furthermore, it is additionally or alternatively also conceivable that the vertical form fill sealing machine 10*a* comprises at least one mechanical control element which is intended to be operated manually by a user. Exemplarily, the at least one mechanical control element is implemented as a lever, as a mechanical adjustment wheel or the like. The transverse sealing device 10*a* is rotatable at least substantially as a whole by means of the drive unit 30*a* of the vertical form fill sealing machine 10*a* and/or manually by means of the at least one mechanical control element during operation of the vertical form fill sealing 10*a* machine, in particular during sealing of the packaging material and/or filling of packages. Additionally or alternatively, it is also conceivable that the transverse sealing device 14*a* is rotatable at least substantially as a whole when the vertical form fill sealing machine 10*a* does not fill packages and/or seal packaging material. Alternatively or additionally, it is also conceivable that the transverse sealing 10*a* device is rotatable at least substantially as a whole around the rotation axis 16*a* of the transverse sealing device 14*a* by hand free from any addition mechanical control elements or the like.

FIG. 3 shows the transverse sealing device 14*a* in a detailed view. The at least two sealing jaws 18*a*, 20*a* are movably, in particular linearly movably, connected to the frame 70*a*, in particular via the guide unit 82*a* of the transverse sealing device 14*a*. The transverse sealing device 14*a* comprises the guide unit 82*a* to guide the at least two sealing jaws 18*a*, 20*a* during a movement, in particular relative to the frame 70*a*. The transverse sealing device 14*a*, in particular the guide unit 82*a* of the transverse sealing device 14*a*, comprises two guide elements 64*a*, 74*a* to guide the at least two sealing jaws 18*a*, 20*a* during a vertical movement of the at least two sealing jaws 18*a*, 20, in particular relative to the frame 70*a* and/or the machine frame 12*a*. Alternatively, it is also conceivable that the transverse sealing device 14*a*, in particular the guide unit 82*a* of the transverse sealing device 14*a*, comprises only one guide element or more than two guide elements. The two guide elements 64*a*, 74*a* of the guide unit 82*a* of the transverse sealing device 14*a* are embodied as guide rods, which are in particular arranged rotatably relative to the frame 70*a*. Alternatively it is also conceivable that the two guide elements 64*a*, 74*a* of the guide unit 82*a* of the transverse sealing device 14*a* are embodied as other guide elements that appear reasonable to a person skilled in the art. The guide unit 82*a* of the transverse sealing device 14*a* comprises two further guide elements 84*a* to guide the at least two sealing jaws 18*a*, 20*a* during a horizontal movement of the at least two sealing jaws 18*a*, 20*a* relative to each other. The two further guide elements 84*a* of the guide unit 82*a* of the transverse sealing device 14*a* are embodied differently from the two guide elements 64*a*, 74*a* of the guide unit 82*a*. The two further guide elements 84*a* of the guide unit 82*a* of the transverse sealing device 14*a* are implemented as guide rods or the like, which are in particular arranged in a rotationally fixed manner relative to the frame 70*a*.

The transverse sealing device 14*a* comprises at least one movement unit 36*a* to move the at least two sealing jaws 18*a*, 20*a*, in particular translationally, relative to each other along a direction parallel to a horizontal movement axis 38*a* of the guide unit 82*a* of the transverse sealing device 14*a* and/or to move the at least two sealing jaws 18*a*, 20*a*, in particular translationally, along a direction parallel to a vertical movement axis 40*a* of the guide unit 82*a* of the transverse sealing device 14*a*. The transverse sealing device 14*a* comprises at least to drive units 42*a*, 44*a* to provide a driving force so as to generate a horizontal movement and/or a vertical movement of the at least two sealing jaws 18*a*, 20*a*, preferably relative to the frame 70*a* and/or relative to the machine frame 12*a*. One drive unit 44*a* of the at least two drive units 42*a*, 44*a* is configured to drive the movement unit 36*a* so as to generate a horizontal movement of the at least two sealing jaws 18*a*, 20*a* relative to each other. At least one further drive unit 42*a* of the at least two drive units 42*a*, 44*a* is configured to drive the movement unit 36*a* so as to generate a vertical movement of the at least two sealing jaws 18*a*, 20*a*. Alternatively, it is also conceivable that the drive unit 44*a* or the further drive unit 42*a* is configured to drive the movement unit 36*a* so as to generate the horizontal movement and the vertical movement of the at least two sealing jaws 18*a*, 20*a*. The further drive unit 42*a* of the at least two drive units 42*a*, 44*a* comprises a lifting fork, a transmission belt, a gear wheel, or the like for transmitting a driving force of the at least one further drive unit 42*a* to the at least two sealing jaws 18*a*, 20*a* in order to generate a vertical movement of the at least two sealing jaws 18*a*, 20*a*, in particular relative to the frame 70*a*. Alternatively it is also conceivable that the further drive unit 42*a* is configured for driving the movement unit 36*a* to generate the vertical movement of the at least two sealing jaws 18*a*, 20*a*, in particular relative to the frame 70*a*. The horizontal movement axis of the at least two sealing jaws 18*a*, 20*a* relative to each other runs along the direction parallel to the horizontal movement axis 38*a* of the guide unit 82*a* of the transverse sealing device 14*a*. The vertical movement of the at least two sealing jaws 18*a*, 20*a* runs along the direction parallel to the vertical movement axis 40*a* of the guide unit 82*a* of the transverse sealing device 14*a*. The at least two drive units 42*a*, 44*a* of the transverse sealing device 14*a* are implemented as electromotors. Alternatively, it is also conceivable that the at least two drive units 42*a*, 44*a* of the transverse sealing device 14*a* are implemented as pneumatic motors or as another drive unit that appears reasonable to a person skilled in the art. The drive unit 44*a* and the further drive unit 42*a* of the transverse sealing device 14*a* are arranged in an at least substantially positionally fixed manner relative to the machine frame 12*a*. In particular, that a drive unit is arranged "in an at least substantially positionally fixed manner" means free from any movement other than a movement of mechanical components of the drive unit which inevitably move during operation of the drive unit.

The horizontal movement axis 38*a* of the guide unit 82*a* of the transverse sealing device 14*a* runs at least substantially perpendicularly to the rotation axis 16*a* of the transverse sealing device 14*a*. The term "substantially perpendicularly" is here in particular to mean an orientation of a direction relative to a reference direction, wherein the direction and the reference direction, in particular viewed in a projection plane, include a 90°-angle and the angle has a maximum deviation of in particular less than 8°, advantageously less than 5° and especially advantageously less than 2°. The vertical movement axis 40*a* of the guide unit 82*a* of the transverse sealing device 14*a* runs at least substantially parallel to the rotation axis 16*a* of the transverse sealing device 14*a*. The term "substantially parallel" is here in particular to mean an orientation of a direction relative to a reference direction, in particular in a plane, wherein the direction has a deviation from the reference direction that is smaller than 8°, advantageously smaller than 5° and especially advantageously smaller than 2°. The at least two sealing jaws 18*a*, 20*a* are configured to seal a packaging material, which is in particular arrangeable between the at least two sealing jaws 18*a*, 20*a*. The horizontal movement axis 38*a* of the guide unit 82*a* of the transverse sealing device 14*a* runs at least substantially perpendicularly to the sealing surfaces 76*a* of the at least two sealing jaws 18*a*, 20*a*. The sealing surfaces 76*a* of the at least two sealing jaws 18*a*, 20*a* run at least substantially perpendicularly to the vertical movement axis 38*a* of the guide unit 82*a* of the transverse sealing device 14*a*. The rotation axis 16*a* of the transverse sealing device 14*a* runs at least substantially parallel to the sealing surfaces 76*a* of the at least two sealing jaws 18*a*, 20*a*.

The movement unit 36*a* is arranged at least substantially completely sideways relative to the at least two sealing jaws 18*a*, 20*a*, at least viewed in a direction parallel to a horizontal movement axis 38*a* of the guide unit 82*a* of the transverse sealing device 14*a*. By the fact that an object is arranged "at least substantially completely sideways relative to a further object" is here in particular to be understood that at least 50%, preferably 75% and particularly preferably at least 90% of a total volume and/or a total mass of the object are arranged sideways relative to the further object. Preferably, in at least one operation state of the movement unit, the movement unit is arranged completely sideways relative to the at least two sealing jaws, at least viewed in the direction parallel to the horizontal movement axis. The movement unit 36*a* is embodied differently from the drive unit 44*a* and/or the further drive unit 42*a*. The movement unit 36*a* is embodied differently from a guide unit 82*a* of the transverse sealing device 14*a*, in particular at least differently from positionally fixed guide elements of the transverse sealing device 14*a*. The guide unit 82*a* of the transverse sealing device 14*a* is preferably configured to guide a movement of the at least two sealing jaws 18*a*, 20*a*. The at least two sealing jaws 18*a*, 20*a* are, in particular linearly, movably supported along the direction parallel to the horizontal movement axis 38*a* of the guide unit 82*a* of the transverse sealing device 14*a*. The at least two sealing jaws 18*a*, 20*a* are, in particular linearly, movably supported along the direction parallel to a vertical movement axis 40*a* of the guide unit 82*a* of the transverse sealing device 14*a*.

The movement unit 36*a* is configured to convert a power generatable by the drive unit 44*a* and/or the further drive unit 42*a* and acting onto the at least two sealing jaws 18*a*, 20*a* into a horizontal movement of the at least two sealing jaws 18*a*, 20*a* relative to each other and/or to generate a vertical movement of the at least two sealing jaws 18*a*, 20*a*, in particular relative to the frame 70*a* and/or the machine frame 12*a*. The vertical movement axis 40*a* extends at least substantially parallel to the sealing surfaces 76*a* of the at least two sealing jaws 18*a*, 20*a* and/or at least substantially perpendicularly to the horizontal movement axis 38*a*.

The movement unit 36*a* is arranged sideways relative to the at least two sealing jaws 18*a*, 20*a* in such a way that the movement unit 36*a* is positioned at least substantially completely within a proximity area of the at least two sealing jaws 18*a*, 20*a*. By the fact that the movement unit 36*a* is arranged sideways relative to the at least two sealing jaws 18*a*, 20*a* in such way that the movement unit 36*a* is positioned at least substantially completely within the proximity area of the at least two sealing jaws 18*a*, 20*a*, is here to be understood that the movement unit 36*a* is arranged sideways relative to the at least two sealing jaws 18*a*, 20*a* in such a way that at least 50%, preferably 75% and particularly preferably at least 90% of a total volume and/or a total mass of the movement unit 36*a* are arranged sideways relative to the at least two sealing jaws 18*a*, 20*a* within the proximity area of the at least two sealing jaws 18*a*, 20*a*. In particular, the proximity area of the at least two sealing jaws 18*a*, 20*a* extends by up to 20%, preferably by up to 10% and particularly preferably by up to 5% of a maximum movement range of the at least two sealing jaws 18*a*, 20*a* in the direction parallel to the horizontal movement axis 38*a* beyond the at least two sealing jaws 18*a*, 20*a*. Preferably, the proximity area of the at least two sealing jaws 18*a*, 20*a* extends by up 20%, preferably by up to 10% and particularly preferably by up to 5% of a maximum movement range of the at least two sealing jaws 18*a*, 20*a* along the direction parallel to the vertical movement axis 38*a* beyond the at least two sealing jaws 18*a*, 20*a*. Particularly preferably, the proximity area of the at least two sealing jaws 18*a*, 20*a* extends by up to 20%, preferably up to 10% and particularly preferably up to 5% of a maximum extension of the at least two sealing jaws 18*a*, 20*a* perpendicularly to the vertical movement axis 40*a* and the horizontal movement axis 38*a*, beyond the at least two sealing jaws 18*a*, 20*a*.

The at least two sealing jaws 18*a*, 20*a* are pullable into a sealing position by means of the movement unit 36*a*. The at least two sealing jaws 18*a*, 20*a* are movable relative to each other into the sealing position free from a direct pushing movement on the at least two sealing jaws 18*a*, 20*a* by means of the movement unit 36*a*. The at least two sealing jaws 18*a*, 20*a* are pullable, relative to each other, into the sealing position along the direction parallel to the horizontal movement axis 38*a* by means of the movement unit 36*a*. The movement unit 36*a* is connected to the at least two sealing jaws 18*a*, 20*a* in such a way that the movement unit 36*a* is configured to generate a direct pulling force to pull the at least two sealing jaws 18*a*, 20*a* relative to each other into the sealing position. The movement unit 36*a* is connected to the at least two sealing jaws 18*a*, 20*a* in such a way that the at least two sealing jaws 18*a*, 20*a* are moved, in particular pulled, relative to each other in a synchronous movement. Alternatively it is also conceivable that the movement unit 36*a* is connected to the at least two sealing jaws 18*a*, 20*a* in such a way that the at least two sealing jaws 18*a*, 20*a* are moved, in particular pulled, relative to each other in an asynchronous movement.

The movement unit 36*a* comprises four movement elements 46*a*, 48*a*, 54*a*, 56*a*, in particular mechanical connection elements. Exemplarily, the four movement elements 46*a*, 48*a*, 54*a*, 56*a* are implemented as arms. Alternatively it is also conceivable that the four movement elements 46*a*, 48*a*, 54*a*, 56*a* are implemented as beams, as bearing elements, as gear wheels or the like. Alternatively, it is also conceivable that the movement unit 36*a* comprises merely one movement element or more than four movement elements. The four movement elements 46*a*, 48*a*, 54*a*, 56*a* are implemented identically to each other. Alternatively, it is also conceivable that the four movement elements 46*a*, 48*a*, 54*a*, 56*a* are embodied differently from each other. Two movement elements 46*a*, 48*a*, 54*a*, 56*a* of the four movement elements 46*a*, 48*a*, 54*a*, 56*a* are each movably, in particular rotatably, connected to one of the at least two sealing jaws 18*a*, 20*a*.

As an example, one movement element 46*a* of the four movement elements 46*a*, 48*a*, 54*a*, 56*a* is described here. The movement element 46*a* is directly, preferably movably, in particular rotatably, connected to one sealing jaw 18*a* of the at least two sealing jaws 18*a*, 20*a*. At least one further movement element 48*a* of the four movement elements 46*a*, 48*a*, 54*a*, 56*a* is directly, preferably movably, in particular rotatably, connected to a further sealing jaw 20*a* of the at least two sealing jaws 18*a*, 20*a*. The movement element 46*a* and the further movement element 48*a* are movable relative to each other, wherein preferably a movement of the at least two sealing jaws 18*a*, 20*a* relative to each other is generatable by a relative movement of the movement element 46*a* and the further movement element 48*a*. By a relative movement of the movement element 46*a* and the further movement element 48*a* the at least two sealing jaws 18*a*, 20*a* are pushable or pullable. The movement element 46*a* and the further movement element 48*a* are movable relative to each other to pull the at least two sealing jaws 18*a*, 20*a* towards each other into the sealing position. The movement of the movement element 46*a* and the further movement element 48*a* relative to each other, for moving the at least two sealing jaws 18*a*, 20*a* relative to each other, in particular into the sealing position, is generatable by a rotating movement of the movement unit 36*a*, in particular by a rotation of at least one additional movement element 86*a* of the movement unit 36*a*. Alternatively, it is also conceivable that the movement element 46*a* and the further movement element 48*a* are movable relative to each other to move the at least two sealing jaws 18*a*, 20*a* relative to each other by a pushing and/or pulling movement of the movement unit 36*a*, in particular by a pushing and/or pulling movement of the additional movement element 86*a* of the movement unit 36*a*.

The movement unit 36*a* comprises two torque resistant linear bushings 62*a*, 68*a*. The additional movement element 86*a* is constituted by one torque resistant linear bushing 62*a* of the at least two torque resistant linear bushings 62*a*, 68*a*. Alternatively, it is also conceivable that the movement unit 36*a* comprises merely one torque resistant linear bushing 62*a* or more than two torque resistant linear bushings. The at least two torque resistant linear bushings 62*a*, 68*a* are configured to transmit a drive torque, in particular from the at least one drive unit 44*a*, for moving the at least two sealing jaws 18*a*, 20*a* relative to each other along the direction parallel to the horizontal axis 38*a*. On each side of the at least two sealing jaws 18*a*, 20*a*, one of the two torque resistant linear bushings 62*a*, 68*a* is arranged, at least viewed in the direction parallel to the horizontal movement axis 38*a* guide unit 82*a* of the transverse sealing device 14*a*. The at least two torque resistant linear bushings 62*a*, 68*a* are arranged on averted sides of the at least two sealing jaws 18*a*, 20*a*, in particular sideways, at least viewed in a direction perpendicular to the horizontal movement axis 38*a* and the vertical movement axis 40*a* of guide unit 82*a* of the transverse sealing device 14*a*.

The movement element 46*a* and the further movement element 48*a* are movably, in particular rotatably, connected to one torque resistant linear bushing 62*a* of the two torque resistant linear bushings 62*a*, 68*a*. The torque resistant linear bushing 62*a*, the movement element 46*a* and the further movement element 48*a* are components of a crank slider mechanism 100*a*. The crank slider mechanism 100*a* is configured to transmit a driving force generatable by the drive unit 44*a* into a horizontal movement of the at least two sealing jaws 18*a*, 20*a*. The torque resistant linear bushing 62*a* is configured to transmit a driving force, in particular from the drive unit 44*a*, to the movement element 46*a* and the further movement element 48*a* for moving the at least two sealing jaws 18*a*, 20*a* relative to each other along the direction parallel to the horizontal movement axis 38*a*. A connection of two further movement elements 54*a*, 56*a* of the four movement elements 46*a*, 48*a*, 54*a*, 56*a*, one further additional movement element 88*a* of the movement unit 36*a*, in particular one further torque resistant linear bushing 68*a* of the two torque resistant linear bushings 62*a*, 68*a*, and the drive unit 44*a* is analogous to a connection of the movement element 46*a*, the further movement element 48*a*, the additional movement element 86*a*, in particular the torque resistant linear bushing 62*a* of the two torque resistant linear bushing 62*a*, 68*a*, and the drive unit 44*a*.

It is conceivable that the movement unit 36*a*, in particular at least one of the four movement elements 46*a*, 48*a*, 54*a*, 56*a* of the movement unit 36*a*, and the at least two sealing jaws 18*a*, 20*a*, in particular the movement area 60*a* of the at least two sealing jaws 18*a*, 20*a*, overlap with each other at least partially in at least one operation state of the at least two sealing jaws 18*a*, 20*a*, at least viewed in a direction perpendicular to the horizontal movement axis 38*a* of the guide unit 82*a* of the transverse sealing device 14*a*. An area behind and on front of the at least two sealing jaws 18*a*, 20*a* is at least substantially completely free from the movement unit 36*a*, at least viewed in the direction parallel to the horizontal movement axis 38*a* of the guide unit 82*a* of the transverse sealing device 14*a*.

The two torque resistant linear bushings 62*a*, 68*a* are each movably, in particular linearly movably, connected to one of the two guide elements 64*a*, 74*a* of the guide unit 82*a* of the transverse sealing device 14*a*. The at least one drive unit 44*a* is configured to drive the at least two guide elements 64*a*, 74*a* of the guide unit 82*a* of the transverse sealing device 14*a* to rotate around rotation axes 66*a* of the at least two guide elements 64*a*, 74*a* of the guide unit 82*a* of the transverse sealing device 14*a* in order to generate a horizontal movement of the two sealing jaws 18*a*, 20*a* relative to each other. The movement unit 36*a* is constituted by the two torque resistant linear bushings 62*a*, 68*a*, the two guide elements 64*a*, 74*a* of the guide unit 82*a* of the transverse sealing device 14*a* and the four movement elements 46*a*, 48*a*, 54*a*, 56*a*. Alternatively it is also conceivable that the movement unit 36*a* is constituted differently, in particular in a manner that appears reasonable to a person skilled in the art. The two torque resistant linear bushings 62*a*, 68*a* are each connected to one of the two guide elements 64*a*, 74*a* of the guide unit 82*a* of the transverse sealing device 14*a* in a rotationally fixed manner. The at least two guide elements 64*a*, 74*a* of the guide unit 82*a* of the transverse sealing device 14*a* are arranged at least substantially completely sideways relative to the at least two sealing jaws 18*a*, 20*a*, at least viewed in a direction parallel to the horizontal movement axis 38*a* of the guide unit 82*a* of the transverse sealing device 14*a*. Main extension axes of the at least two guide elements 64*a*, 74*a* of the guide unit 82*a* of the transverse sealing device 14*a* are at least substantially perpendicular to the horizontal movement axis 38*a* of the guide unit 82*a* of the transverse sealing device 14*a*. The main extension axes of the at least two guide elements 64*a*, 74*a* of the guide unit 82*a* of the transverse sealing device 14*a* are at least substantially parallel to the vertical movement axis 40*a* of the guide unit 82*a* of the transverse sealing device 14*a*. The main extension axes of the two guide elements 64*a*, 74*a* of the guide unit 82*a* of the transverse sealing device 14*a* correspond to their rotation axes 66*a*. A drive force of the drive unit 44*a* is transmittable to the two guide elements 64*a*, 74*a* of the guide unit 82*a* of the transverse sealing device 14*a* by means of a transmission belt, a gear wheel, or the like of the drive unit. The two guide elements 64*a*, 74*a* of the guide unit 82*a* of the transverse sealing device 14*a* constitute two further additional movement elements 90*a* of the movement unit 36*a*. The guide elements 64*a*, 74*a* of the guide unit 82*a* of the transverse sealing device 14*a* are rotatably connected to the frame 70*a* of the transverse sealing device 70*a*.

The two torque resistant linear bushings 62*a*, 68*a* can each be moved along the two guide elements 64*a*, 74*a* of the guide unit 82*a* of the transverse sealing device 14*a* for a vertical movement of the at least two sealing jaws 18*a*, 20*a*. The vertical movement of the at least two sealing jaws 18*a*, 20*a* is directly linked with a vertical movement of the two torque resistant linear bushings 62*a*, 68*a*. The at least one further drive unit 42*a* is configured to drive the movement unit 36*c* to generate the vertical movement of the at least two sealing jaws 18*a*, 20*a* relative to the frame 70*a*.

Figure 4:
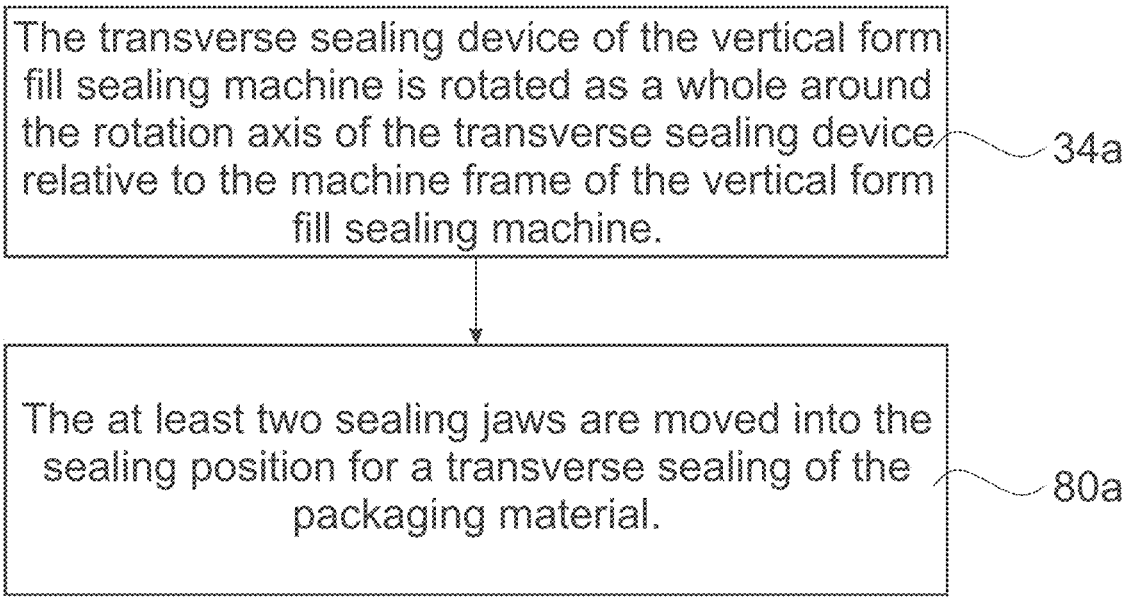

FIG. 4 shows schematically a flow chart of a method for operating the vertical form fill sealing machine 10*a*. In a process step 34*a* the transverse sealing device 14*a* of the vertical form fill sealing machine 10*a* is rotated at least substantially as a whole around the rotation axis 16*a* of the transverse sealing device 14*a* relative to the machine frame 12*a* of the vertical form fill sealing machine 10*a*. It is conceivable that in the process step 34*a* the transverse sealing device 14*a* is rotated substantially as a whole during a sealing of the packaging material and/or a filling of packages, preferably by means of the drive unit 30*a* of the vertical form fill sealing machine 10*a* and/or manually by the at least one mechanical control element. It is also conceivable that in the process step 34*a* the transverse sealing device 14*a* is rotated at least substantially as a whole while the vertical form fill sealing machine 10*a* is not filling packages and/or sealing packaging material, preferably by means of the drive unit 30*a* of the vertical form fill sealing machine 10*a* and/or manually by the at least one mechanical control element. Preferably, in the process step 34*a* the transverse sealing device 14*a* is rotated at least substantially as a whole through an angle of 90° around the rotation axis 16*a* of the transverse sealing device 14*a* relative to the machine frame 12*a*. Alternatively, it is also conceivable that in the process step 34*a* the transverse sealing device 14*a* is rotated at least substantially as a whole around the rotation axis 16*a* of the transverse sealing device 14*a* through an angle other than 90° relative to the machine frame 12*a*.

In the process step 34*a* the transverse sealing device 14*a* is steplessly rotated substantially as a whole around the rotation axis 16*a* from the one work position of the transverse sealing device 14*a* for a transverse sealing of a packaging material to the further work position of the transverse sealing device 14*a* for a transverse sealing of a packaging material. In the process step 34*a* the transverse sealing device 14*a* is rotated at least substantially as a whole around the rotation axis 16*a* of the transverse sealing device 14*a* that is fixed in position relative to the machine frame 12*a* of the vertical form fill sealing machine 10*a* from the one work position of the transverse sealing device 14*a* for a transverse sealing of a packaging material to the further work position of the transverse sealing device 14*a* for a transverse sealing of a packaging material. Particularly preferably, in the process step 34*a* the transverse sealing device 14*a* is rotated substantially as a whole around the rotation axis 16*a* of the transverse sealing device 14*a*, in particular by means of the drive unit 30*a* of the vertical form fill sealing machine 10*a* and/or manually by means of the at least one mechanical control element, from the work position to the further work position free from any translational movement of the transverse sealing device 14*a* relative to the machine frame 12*a*.

In a further process step 80*a* the at least two sealing jaws 18*a*, 20*a* are moved into the sealing position for a transverse sealing of the packaging material. It is also conceivable that the at least two sealing jaws 18*a*, 20*a* are moved into the sealing position for a transverse sealing of the packaging material in the process step 34, in particular during the rotation of the transverse sealing device 14*a* around the rotation axis 16*a* of the transverse sealing device 14*a* relative to the machine frame 12*a*.

Figure 5:
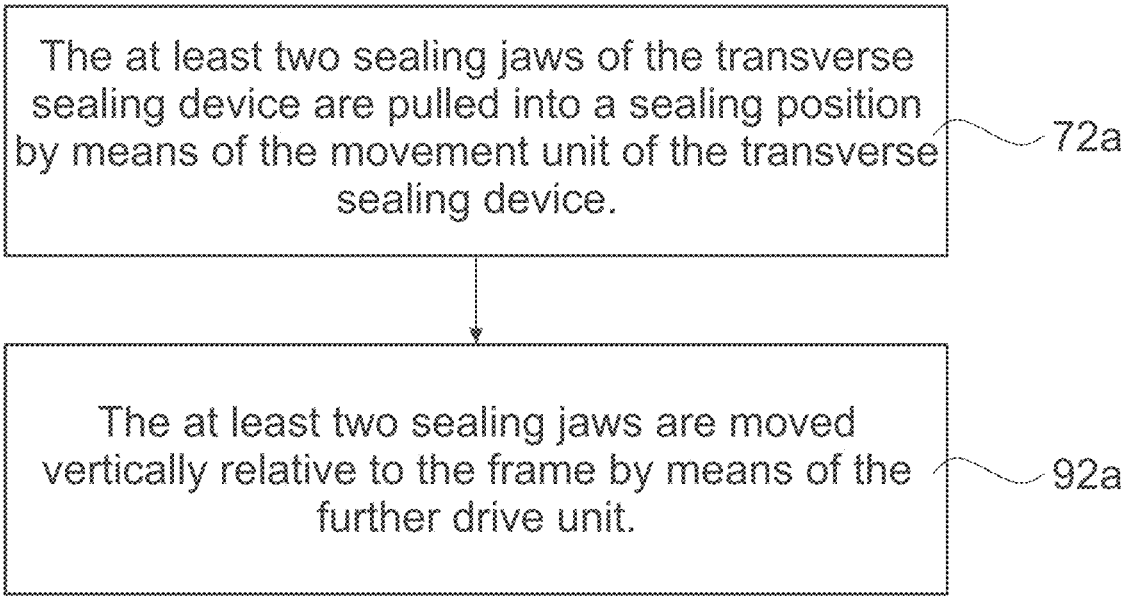

FIG. 5 shows schematically a flow chart of a method for operating the transverse sealing device 14*a* for sealing a package or a packaging material. In a process step 72*a* the at least two sealing jaws 18*a*, 20*a* of the transverse sealing device 14*a* are pulled into a sealing position by means of the movement unit 36*a* of the transverse sealing device 14*a*. In the process step 72*a* at least the movement element 46*a* and the at least one further movement element 48*a* of the two movement elements 46*a*, 48*a* of the movement unit 36*a* are moved by the drive unit 44*a* relative to each other in order to generate a pulling force for pulling the at least two sealing jaws 18*a*, 20*a* towards each other into the sealing position. In the process step 72*a* a driving force for moving the at least two sealing jaws 18*a*, 20*a* relative to each other along the direction parallel to the horizontal movement axis 38*a* is transmitted by the two torque resistant linear bushings 62*a*, 68*a* of the movement unit 36*a*. In the process step 72*a* the drive unit 44*a* drives the guide elements 64*a*, 74*a* of the guide unit 82*a* of the transverse sealing device 14*a* to rotate around their rotation axes 66*a* in order to generate a rotation of the two torque resistant linear bushings 62*a*, 68*a*. In the process step 72*a* the rotational force of the torque resistant linear bushing 62*a* of the two torque resistant linear bushings 62, 68*a* is converted into a relative movement of the movement element 46*a* and the further movement element 48*a* in order to generate a pulling or pushing force for moving the at least two sealing jaws 18*a*, 20*a* relative to each other along the direction parallel to the horizontal movement axis 38*a* of the guide unit 82*a* of the transverse sealing device 14*a*. This applies analogously to the further torque resistant linear bushing 68*a* of the two torque resistant linear bushings 62*a*, 68*a* and the two further movement elements 54*a*, 56*a*. In a further process step 92*a* the at least two sealing jaws 18*a*, 20*a* are moved vertically relative to the frame 70*a* by means of the further drive unit 42*a*.

In FIGS. 6 to 13 further exemplary embodiments of the invention are illustrated. The following description and the drawings are essentially limited to the differences between the exemplary embodiments, wherein as regards identically denominated components, in particular components having the same reference numerals, the drawings and/or the description of the other exemplary embodiment, in particular of FIGS. 1 to 5, may principally be referred to. In order to distinguish between the exemplary embodiments, the letter a has been added to the reference numerals of the exemplary embodiment of FIGS. 1 to 5. In the exemplary embodiments of FIGS. 6 to 13 the letter a has been substituted by the letters b to g. In particular, it is also conceivable that a transverse sealing device is embodied differently from the exemplary embodiments shown here.

Figure 6:
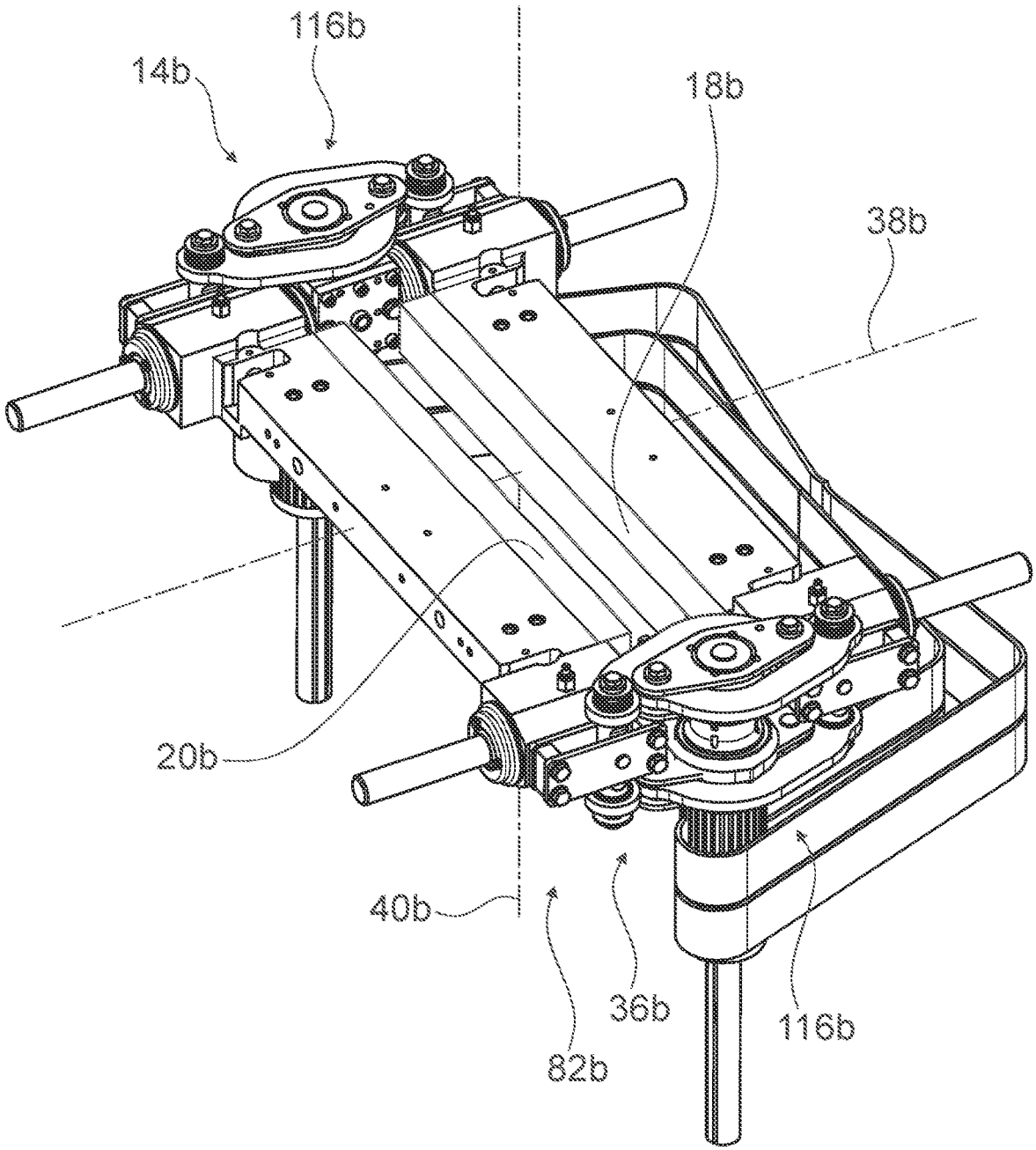

In FIG. 6 a transverse sealing device 14*b* is shown for a sealing of a package or a packaging material. The transverse sealing device 14*b* comprises at least two sealing jaws 18*b*, 20*b*. The transverse sealing device 14*b* comprises at least one movement unit 36*b* for moving the at least two sealing jaws 18*b*, 20*b* translationally relative to each other along a direction parallel to a horizontal movement axis 38*b* of a guide unit 82*b* of the transverse sealing device 14*b* and for moving the at least two sealing jaws 18*b*, 20*b* translationally along a direction parallel to a vertical movement axis 40*b* of the guide unit 82*b* of the transverse sealing device 14*b*, in particular relative to a frame (not shown here) of the transverse sealing device 14*b*. The movement unit 36*b* comprises two ball-screw slide mechanisms 116*b*, which are in particular arranged on averted sides of the at least two sealing jaws 18*b*, 20*b*. By means of the two ball-screw slide mechanisms 116*b*, a driving force of at least one drive unit (not shown here) of the transverse sealing device 14*b* can be converted into a horizontal movement and a vertical movement of the at least two sealing jaws 18*b*, 20*b*, in particular relative to the frame. The movement unit 36*b* is arranged at least substantially completely sideways relative to the at least two sealing jaws 18*b*, 20*b*, at least viewed in a direction parallel to the horizontal movement axis 38*b* of the guide unit 82*b* of the transverse sealing device 14*b*. The movement unit 36*b* is arranged sideways relative to the at least two sealing jaws 18*b*, 20*b* in such a way that the movement unit 36*b* is positioned at least substantially completely within a proximity area of the at least two sealing jaws 18*b*, 20*b*, at least viewed in the direction parallel to the horizontal movement axis 38*b* of the guide unit 82*b* of the transverse sealing device 14*b*. The at least two sealing jaws 18*b*, 20*b* are pullable into a sealing position by means of the movement unit 36*b*.

Figure 7:
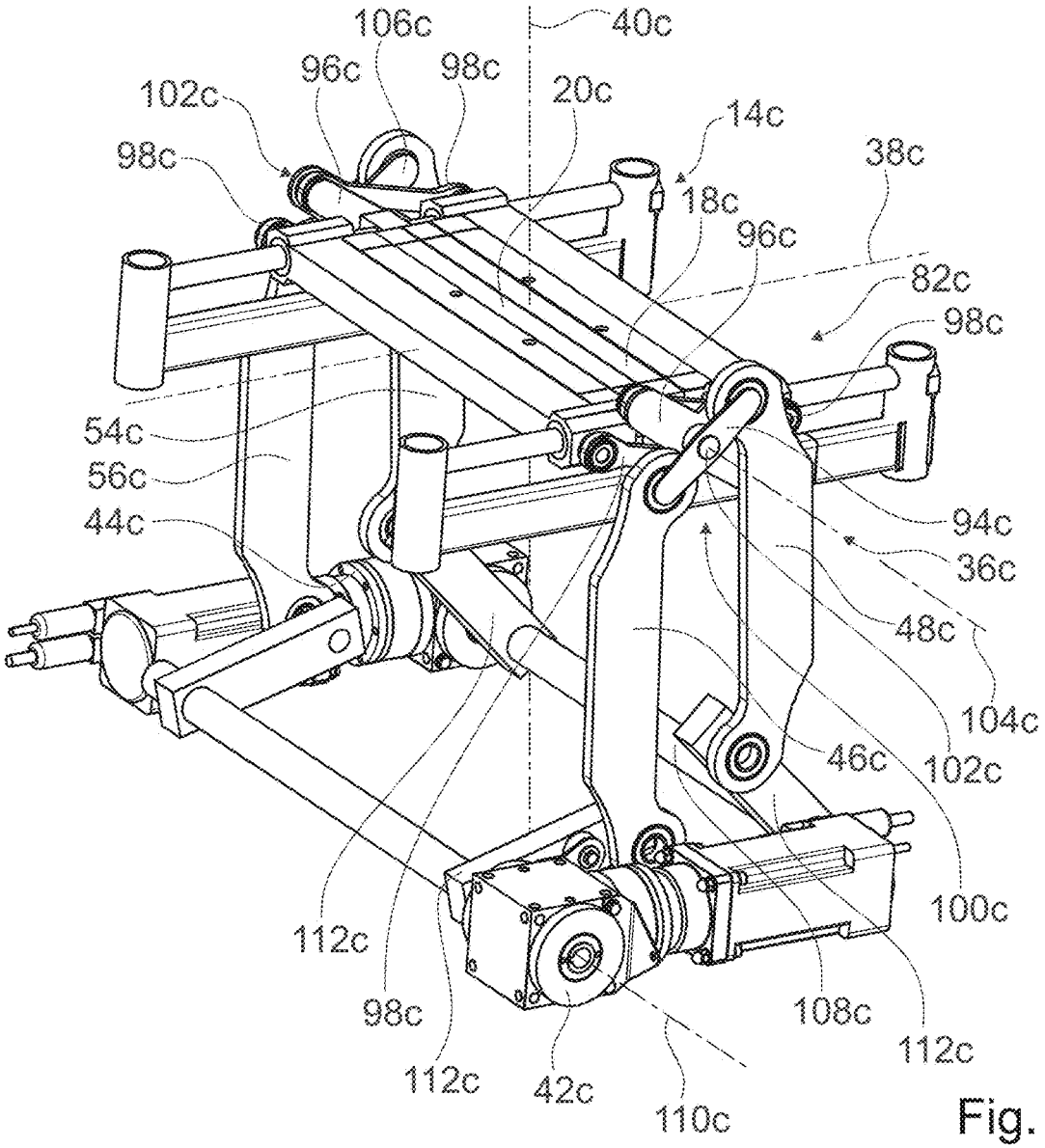

In FIG. 7 a transverse sealing device 14*c* is shown for a sealing of a package or a packaging material. The transverse sealing device 14*c* comprises at least two sealing jaws 18*c*, 20*c*. The transverse sealing device 14*c* comprises at least one movement unit 36*c* for moving the at least two sealing jaws 18*c*, 20*c* translationally relative to each other along a direction parallel to a horizontal movement axis 38*c* of a guide unit 82*c* of the transverse sealing device 14*c* and for moving the at least two sealing jaws 18*c*, 20*c* translationally along a direction parallel to a vertical movement axis 40*c* of the guide unit 82*c* of the transverse sealing device 14*c*, in particular relative to a frame (not shown here) of the transverse sealing device 14*c*. The transverse sealing device 14*c* comprises at least two drive units 42*c*, 44*c* for driving the movement unit 36*c*.

The at least two drive units 42*c*, 44*c* are connected to each other by the movement unit 36*c* in such a way that a horizontal movement and/or a vertical movement of the that least two sealing jaws 18*c*, 20*c* is generatable by a joint drive of the movement unit 36*c* by means of the at least two drive units 42*c*, 44*c*. A horizontal and/or a vertical movement of the at least two sealing jaws 18*c*, 20*c* is only generatable by a drive executed by all of the at least two drive units 42*c*, 44*c*. If at least one of the at least two drive units 42*c*, 44*c* is in a resting state, the movement unit 36*c* is blocked from any movement, in particular other than vibrational movements causable by a drive of the movement unit 36*c* by only one of the at least two drive units 42*c*, 44*c*, for generating a horizontal movement and/or a vertical movement of the at least two sealing jaws 18*c*, 20*c*. If the movement unit 36*c* is free from a drive executed by at least one of the at least two drive units 42*c*, 44*c*, a movement of the movement unit 36*c* for generating a horizontal movement and/or a vertical movement of the at least two sealing jaws 18*c*, 20*c* is blocked.

The movement unit 36*c* is drivable by the joint drive by means of the at least two drive units 42*c*, 44*c* in such a way that merely a horizontal movement of the at least two sealing jaws 18*c*, 20*c* is generated, in particular relative to a frame (not shown here) of the transverse sealing device 14*c*. The movement unit 36*c* is drivable by the joint drive by means of the at least two drive units 18*c*, 20*c* in such a way that merely a vertical movement of the at least two sealing jaws 18*c*, 20*c* is generated, in particular relative to the frame of the transverse sealing device 14*c*. It is also conceivable that the movement unit 36*c* is drivable by the joint drive by means of the at least two drive units 42*c*, 44*c* in such a way that simultaneously a horizontal movement and a vertical movement of the at least two sealing jaws 18*c*, 20*c* is generated, in particular relative to the frame of the transverse sealing device 14*c*.

The movement unit 36*c* comprises two movement elements 46*c*, 48*c* in order to create a movable connection between the two drive units 42*c*, 44*c* and the at least two sealing jaws 18*c*, 20*c*. The two movement elements 46*c*, 48*c* are implemented as arms. Alternatively, it is also conceivable that the two movement elements 46*c*, 48*c* are implemented as beams, as bearing elements, in particular as torque resistant linear bushings, as gear wheels or the like. The movement unit 36*c* comprises at least one drive connection element 94*c* to connect the at least two drive units 42*c*, 44*c* mechanically to each other. The drive connection element 94*c* is implemented as a beam. Alternatively, it is also conceivable that the drive connection element 94*c* is implemented as an arm, a bearing element, in particular a torque resistant linear bushing, a gear wheel or the like. The drive connection element 94*c* is connected to the at least two drive units 42*c*, 44*c* by the two movement elements 46*c*, 48*c* of the movement unit 36*c*. Alternatively, it is also conceivable that at least one drive unit 42*c*, 44*c* of the at least two drive units 42*c*, 44*c* is directly connected, in particular movably connected, to the drive connection element 94*c*, preferably free from any additional movement elements. The drive connection element 94*c* is connected to the at least two sealing jaws 18*c*, 20*c* via at least one additional movement element 96*c* of the movement unit 36*c*, which is preferably connected to the drive connection element 94*c* in a rotationally fixed manner. The movement unit 36*c* comprises at least two slider elements 98*c*, which are in particular movably, in particular rotatably, connected to the additional movement element 94*c* and/or the at least two sealing jaws 18*c*, 20*c*.

The drive connection element 94*c*, the two slider elements 98*c* and the additional movement element 96*c* are components of a crank slider mechanism 100*c*, which is in particular arranged between the at least two movement elements 46*c*, 48*c* and the at least two sealing jaws 18*c*, 20*c*. The two slider elements 98*c* are implemented as arms. Alternatively, the two slider elements are implemented as beams, bearing elements, gear wheels, or the like. The drive connection element 94*c* is preferably connected to the additional movement element 96*c* via a rod 102*c* or the like. Alternatively it is also conceivable that the additional movement element 96*c* and the drive connection element 94*c* are implemented integrally with each other. The crank slider mechanism 100*c* is preferably configured to convert a driving force generatable by the at least two drive units 18*c*, 20*c*, in particular a movement of the drive connection element 94*c*, into a horizontal and/or vertical movement of the at least two sealing jaws 18*c*, 20*c*. The drive connection element 94*c* is merely movable by the joint drive of the at least two drive units 18*c*, 20*c*. In particular, in a preferred implementation of the invention, the drive connection element can be driven to rotate around a rotation axis 104*c* of the drive connection element 94*c* by the joint drive by means of the at least two drive units 18*c*, 20*c* such as to generate a horizontal movement of the at least two sealing jaws 18*c*, 20*c* The rotation axis 104*c* of the drive connection element 94*c* runs at least substantially parallel to the sealing surfaces 76*a* of at least two sealing jaws 18*c*, 20*c*. The rotation axis 104*c* of the drive connection element 94*c* runs at least substantially perpendicularly to the horizontal movement axis 38*c* of the guide unit 82*c* of the transverse sealing device 14*c* and to the vertical movement axis 40*c* of the guide unit 82*c* of the transverse sealing device 14*c*.

The movement unit 36*c* has an analogous structure on both sides of the at least two sealing jaws 18*c*, 20*c*. The movement unit 36*c* comprises a further drive connection element 106*c*, which is in particular implemented identically to the drive connection element 94*c*. Alternatively it is also conceivable that the further drive connection element 106*c* is embodied differently from the drive connection element 94*c*. The drive connection element 94*c* and the further drive connection element 106*c* are arranged on averted sides of the at least two sealing jaws 18*c*, 20*c*. A connection of the further drive connection element 106*c* to the at least two sealing jaws 18*c*, 20*c* is preferably analogous to a connection of the drive connection element 94*c* to the at least two sealing jaws 18*c*, 20*c*. A connection of the further drive connection element 106*c* to the at least two drive units 42*c*, 44*c* is analogous to a connection of the drive connection element 94*c* to the at least two drive units 42*c*, 44*c*. The movement unit 36*c* comprises at least two further movement elements 54*c*, 56*c*, whose connection with the at least two sealing jaws 18*c*, 20*c* is analogous to a connection of the at least two movement elements 46*c*, 48*c* with the at least two sealing jaws 18*c*, 20*c*. A connection of the at least two further movement elements 54*c*, 56*c* with the further drive connection element 106*c* is analogous to a connection of the at least two movement elements 46*c*, 48*c* with the drive connection element 94*c*. A connection of the at least two further movement elements 54*c*, 56*c* with the at least two drive units 42*c*, 44*c* is analogous to a connection of the at least two movement elements 46*c*, 48*c* with the at least two drive units 42*c*, 44*c*. The at least two movement elements 46*c*, 48*c* and the at least two further movement elements 54*c*, 56*c* are arranged on averted sides of the at least two sealing jaws 18*c*, 20*c*. The at least two drive units 42*c*, 44*c* are arranged at least partially sideways to the at least two sealing jaws 18*c*, 20*c*, at least viewed in a direction parallel to the horizontal movement axis 38*c*. Alternatively, it is also conceivable that the two drive units 42*c*, 44*c* are arranged in a central position relative to the at least two movement elements 46*c*, 48*c* and the at least two further movement elements 54*c*, 56*c*, preferably at least viewed in the direction parallel to the horizontal movement axis 38*c* of the guide unit 82*c* of the transverse sealing device 14*c*. Furthermore, it is alternatively also conceivable that the at least two drive units 42*c*, 44*c* are arranged differently, in particular in a way that appears reasonable to a person skilled in the art. The movement unit 36*c* is implemented of four movement elements 46*c*, 48*c*, 54*c*, 56*c*, in particular the two movement elements 46*c*, 48*c* and the two further movement elements 54*c*, 56*c*, two drive connection elements 94*c*, 106*c*, in particular the drive connection element 94*c* and the further drive connection element 106*c*, four slider elements 98*c*, two of the four slider elements 98*c* being embodied by the already aforementioned at least two slider elements 98*c*, two rods 102*c*, one of the two rods 102*c* being in particular embodied by the already aforementioned rod 102*c*, and two additional movement elements 96*c*, one of the two additional movement elements 96*c* being embodied by the already aforementioned additional movement element 96*c*. Alternatively it is also conceivable that the movement unit 36*c* is implemented of merely one drive connection element, one rod, two movement elements, two slider elements and one additional movement element. Furthermore, other embodiments of the movement unit 36*c* are conceivable which seem to be reasonable for a person skilled in the art. In particular, it is conceivable that the movement unit 36*c* is embodied without any rods 102*c*.

Each of the at least two drive units 42*c*, 44*c* comprises at least one drive shaft 108*c*. A drive direction of a drive unit 42*c*, 44*c* of the at least two drive units 42*c*, 44*c* corresponds to a direction of rotation of a rotation of the drive shaft 108*c* around the rotation axis 110*c* of the drive shaft 108*c*. The rotation axes 110*c* of the drive shafts 108*c* correspond to main extension axes of the respective drive shafts 108*c*. The rotation axes 110*c* of the drive shafts 108*c* of the at least two drive units 42*c*, 44*c* preferably run at least substantially parallel to sealing surfaces of the at least two sealing jaws 18*c*, 20*c*. The rotations axes 110*c* of the drive shafts 108*c* of the at least two drive units 42*c*, 44*c* run at least substantially perpendicularly to the horizontal movement axis 38*c* and the vertical movement axis 40*c* of the guide unit 82*c* of the transverse sealing device 14*c*. The rotation axes 110*c* of the drive shafts 108*c* of the at least two drive units 42*c*, 44*c* run at least substantially parallel to each other. Alternatively it is also conceivable that the rotation axes 110*c* of the drive shafts 108*c* of the at least two drive units 42*c*, 44*c* run transversely, preferably at least substantially perpendicularly, relative to each other. The drive shaft 108*c* of one drive unit 42*c* of the at least two drive units 42*c*, 44*c* is directly connected to one movement element 46*c* of the two movement elements 46*c*, 48*c* and to one movement element 56*c* of the at least two further movement elements 54*c*, 56*c*. A drive shaft 108*c* of a further drive unit 44*c* of the at least two drive units 42*c*, 44*c* is directly connected to a further movement element 48*c* of the at least two movement elements 46*c*, 48*c* and to a further movement element 54*c* of the at least two further movement elements 54*c* 56*c*.

The drive connection element 94*c* and the further drive connection element 106*c* can be driven to move translationally along a direction parallel to a translational movement axis of the drive connection element 94*c* and the further drive connection element 106*c* by the joint drive by means of the at least two drive units 42*c*, 44*c* in order to generate a vertical movement of the at least two sealing jaws 42*c*, 44*c*, in particular relative to the frame of the transverse sealing device 14*c*. The translational movement axis of the drive connection element 94*c* and the further drive connection element 106*c* runs transversely, particularly preferably at least substantially perpendicularly, to the rotation axis 104*c* of the drive connection element 94*c*. The translational movement axis runs preferably at least substantially parallel to the vertical movement axis 40*c* of the guide unit 82*c* of the transverse sealing device 14*c* and/or the sealing surfaces of the at least two sealing jaws 18c, 20c. The translational movement axis runs at least substantially perpendicularly to the horizontal movement axis 40c of the guide unit 82c of the transverse sealing device 14c.

A vertical movement of the at least two sealing jaws 18c, 20c is generatable by a parallel drive of the movement unit 36c by means of the at least two drive units 42c, 44c. A vertical movement of the at least two sealing jaws 18c, 20c is generatable by a parallel drive of the drive connection element 94c and the further drive connection element 106c by means of the at least two drive units 42c, 44c. A parallel drive of the drive connection element 94c and the further drive connection element 106c by the at least two drive units 42c, 44c shall be understood to mean that the movements transmitted to the drive connection element 94c and the further drive connection element 106c, which are generatable by the at least two drive units 42c, 44c, coincide at least in their direction and in their velocity. The components of the crank slider mechanism 100c are, via a parallel drive of the movement unit 36c by means of the at least two drive units 42c, 44c, moved as a whole merely translationally in order to generate a vertical movement of the at least two sealing jaws 18c, 20c. Drive directions of the at least two drive units 42c, 44c for generating a parallel drive of the movement unit 36c, in particular the drive connection element 94c and the further drive connection element 106c, are oriented opposite to each other. Alternatively it is also conceivable that the drive directions of the at least two drive units 42c, 44c coincide in order to generate a parallel drive of the movement unit 36c, in particular the drive connection element 94c and the further drive connection element 106c. It is conceivable that absolute values of drive speeds of the at least two drive units 42c, 44c coincide with or differ from each other for generating a parallel drive of the movement unit 36c, in particular the drive connection element 94c and the further drive connection element 106c, preferably depending on the arrangement of the at least two drive units 42c, 44c relative to each other and/or the arrangement of the movement unit 36c. The drive directions of the at least two drive units 42c, 44c depend on the arrangement of the at least two drive units 42c, 44c relative to each other and/or the arrangement of the movement unit 36c. Alternatively, it is also possible that the two drive units 42c, 44c are arranged and/or implemented in such a way that a parallel drive of the movement unit 36c is generatable by a synchronous operation of the at least two drive units 42c, 44c. The movement unit 36c is arranged in such a way that a parallel drive of the movement unit 36c, in particular the drive connection element 94c and the further drive connection element 106c, generates a translational movement of the drive connection element 94c and the further drive connection element 106c along the direction parallel to the translational movement axis of the drive connection element 94c and the further drive connection element 106c for the purpose of generating a vertical movement of the at least two sealing jaws 18c, 20c, in particular relative to the frame of the transverse sealing device 14c.

A horizontal movement of the at least two sealing jaws 18c, 20c relative to each other is generatable by a non-parallel drive of the movement unit 36c by means of the at least two drive units 42c, 44c. A non-parallel drive of the drive connection element 94c and the further drive connection element 106c by the at least two drive units 42c, 44c is to mean that the movements transmitted to the drive connection element 94c and the further drive connection element 106c, which are generatable by the at least two drive units 42c, 44c, differ at least in their directions. The directions of the movements, which are in particular generatable by means of the at least two drive units 42c, 44c, and are transmitted to the drive connection element 94c and the further drive connection element 106c in the case of a non-parallel drive of the drive connection element 94c and the further drive connection element 106c, are oriented opposite to one another. The movements transmitted to the drive connection element 94c and the further drive connection element 106c by a non-parallel drive of the movement unit 36c, in particular the drive connection element 94c and the further drive connection element 106c, by means of the at least two drive units 42c, 44c coincide at least in a direction and in a velocity. The crank slider mechanism 100c is connected to the at least two drive units 42c, 44c in such a way that by a non-parallel drive of the movement unit 36c by means of the at least two drive units 42c, 44c, the crank slider mechanism 100c is configured to generate a horizontal movement of the at least two sealing jaws 18c, 20c. A horizontal movement of the at least two sealing jaws 18c, 20c, in particular relative to the frame of the transverse sealing device 14c, is generatable by a non-parallel drive of the drive connection element 94c and the further drive connection element 106c by means of the at least two drive units 42c, 44c. It is conceivable that a non-parallel drive of the movement unit 36c, in particular the drive connection element 94c and the further drive connection element 106c, is generatable by an asynchronous operation of the at least two drive units 42c, 44c. The drive directions of the at least two drive units 42c, 44c in this exemplary embodiment coincide for generating a non-parallel drive of the movement unit 36c, preferably the drive connection element 94c and the further drive connection element 106c. The movement unit 36c is arranged in such a way that a non-parallel drive of the movement unit 36c, in particular the drive connection element 94c and the further drive connection element 106c, generates a rotational movement of the drive connection element 94c and the further drive connection element 106c around the rotation axes 104c of the drive connection element 94c and the further drive connection element 106c, in particular in order to generate a horizontal movement of the at least two sealing jaws 18c, 20c. It is conceivable that the absolute values of the drive speeds of the at least two drive units 42c, 44c coincide with or differ from each other in order to generate a parallel drive of the movement unit 36c, in particular the drive connection element 94c and the further drive connection element 106c, preferably depending on the arrangement of the at least two drive units 42c, 44c relative to each other and/or the arrangement of the movement unit 36c. Alternatively it is also conceivable that the drive directions of the at least two drive units 42c, 44c differ from each other, preferably are oriented opposite to each other, for the purpose of generating a non-parallel drive of the movement unit 36c, in particular the drive connection element 94c and the further drive connection element 106c.

The two movement elements 46c, 48c are movably, in particular rotatably, connected to each other. One drive unit 42c of the at least two drive units 42c, 44c is mechanically connected to one movement element 46c of the at least two movement elements 46c, 48c for driving the movement element 46c. A further drive unit 44c of the at least two drive units 42c, 44c is mechanically connected to a further movement element 48c of the at least two movement elements 46c, 48c for driving the further movement element 48c. The two movement elements 46c, 48c and the further two movement elements 54c, 56c are each movably, in particular rotatably, connected to one of the drive shafts 108c of the at least two drive units 42c, 44c, in particular via link arms

112*c* of the at least two drive units 42*c*, 44*c*, which are preferably arranged on the drive shafts 108*c* of the two drive units 42*c*, 44*c* in a fixed position relative to the respective drive shaft 108*c*.

The movement unit 36*c* is arranged at least substantially completely sideways relative to the at least two sealing jaws 18*c*, 20*c*, at least viewed in a direction parallel to the horizontal movement axis 38*c* of the guide unit 82*c* of the transverse sealing device 14*c*. The movement unit 36*c* is arranged sideways relative to the at least two sealing jaws 18*c*, 20*c* in such a way that the movement unit 36*c* is positioned at least substantially completely within a proximity area of the at least two sealing jaws 18*c*, 20*c*, at least viewed in the direction parallel to the horizontal movement axis 38*c* of the guide unit 82*c* of the transverse sealing device 14*c*. The at least two sealing jaws 18*c*, 20*c* are pullable into a sealing position by means of the movement unit 36*c*.

Figure 8:
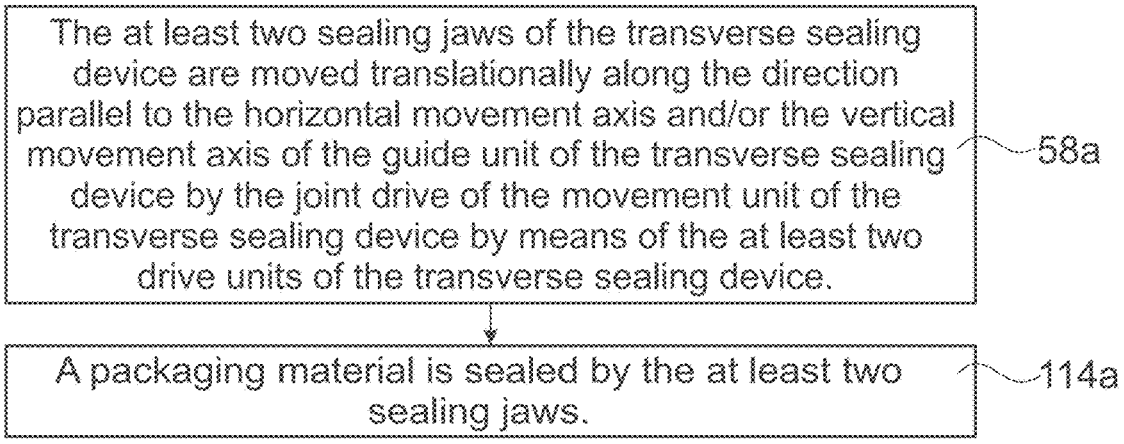

FIG. 8 shows schematically a flow chart of a method for operating the transverse sealing device. In a process step 58*c* the at least two sealing jaws 18*c*, 20*c* of the transverse sealing device 14*c* are moved translationally along the direction parallel to the horizontal movement axis 18*c* and/or the vertical movement axis 40*c* of the guide unit 82*c* of the transverse sealing device 14*c* by the joint drive of the movement unit 36*c* of the transverse sealing device 14*c* by means of the at least two drive units 42*c*, 44*c* of the transverse sealing device 14*c*. The horizontal movement and/or the vertical movement of the at least two sealing jaws 18*c*, 20*c* are/is generated by a drive executed by all of the at least two drive units 42*c*, 44*c*. In the process step 58*c* a power generated by the at least two drive units 42*c*, 44*c* is transmitted by means of the movement unit 36*c* to the at least two sealing jaws 18*c*, 20*c* in order to generate a horizontal movement of the at least two sealing jaws 18*c*, 20*c* relative to each other and/or to generate a vertical movement of the at least two sealing jaws 18*c*, 20*c*, in particular relative to the frame of the transverse sealing device 14*c*. It is conceivable that in the process step 58*c* the movement unit 36*c* is driven by the joint drive by means of the at least two drive units 42*c*, 44*c* in such a way that only a horizontal movement or a vertical movement of the at least two sealing jaws 18*c*, 20*c* is generated. In the process step 58*c* the drive connection element 94*c* and the further drive connection element 106*c* are driven to rotate around the rotation axes 104*c* of the drive connection element 94*c* and the further drive connection element 106*c* by the joint drive by means of the at least two drive units 42*c*, 44*c* for the purpose of generating a horizontal movement of the at least two sealing jaws 18*c*, 20*c*. Alternatively, it is also conceivable that in the process step 58*c* the drive connection element 94*c* and the further drive connection element 106*c* are driven to rotate around the rotation axes 104*c* of the drive connection element 94*c* and the further drive connection element 106*c* by the joint drive by means of the at least two drive units 42*c*, 44*c* for the purpose of generating a vertical movement of the at least two sealing jaws 18*c*, 20*c*. In the process step 58*c* the drive connection element 94*c* and the further drive connection element 106*c* are driven to move translationally along the direction parallel to the translationally movement axis of the drive connection element 94*c* and the further drive connection element 106*c* by the joint drive by means of the at least two drive units 42*c*, 44*c* for the purpose of generating a vertical movement of the at least two sealing jaws 18*c*, 20*c*. In the process step 58*c* a drive force generated by the at least two drive units 42*c*, 44*c*, in particular a movement of the drive connection element 94*c* and the further drive connection element 106*c*, is converted by the crank slider mechanism 100*c* into a horizontal and/or vertical movement of the at least two sealing jaws 18*c*, 20*c*.

In the process step 58*c* the movement unit 36*c*, in particular the at least two movement elements 46*c*, 48*c* of the movement unit 36*c*, is driven in parallel by the at least two drive units 42*c*, 44*c* in order to generate a vertical movement of the at least two sealing jaws 18*c*, 20*c*. In the process step 58*c* the vertical movement of the at least two sealing jaws 18*c*, 20*c* is generated by a parallel drive of the drive connection element 94*c* and the further drive connection element 106*c* by means of the at least two drive units 42*c*, 44*c*. In the process step 58*c* the movement unit 36*c*, in particular the at least two movement elements 46*c*, 48*c* of the movement unit 36*c*, is driven in opposite directions by the at least two drive units 42*c*, 44*c* in order to generate a horizontal movement of the at least two sealing jaws 18*c*, 20*c*. In the process step 58*c* a horizontal movement of the at least two sealing jaws 18*c*, 20*c* is generated by a non-parallel drive of the drive connection element 94*c* and the further drive connection element 106*c* by means of the at least two drive units 42*c*, 44*c*. In a further process step 114*c* a packaging material is sealed by the at least two sealing jaws 18*c*, 20*c*.

Figure 9B:
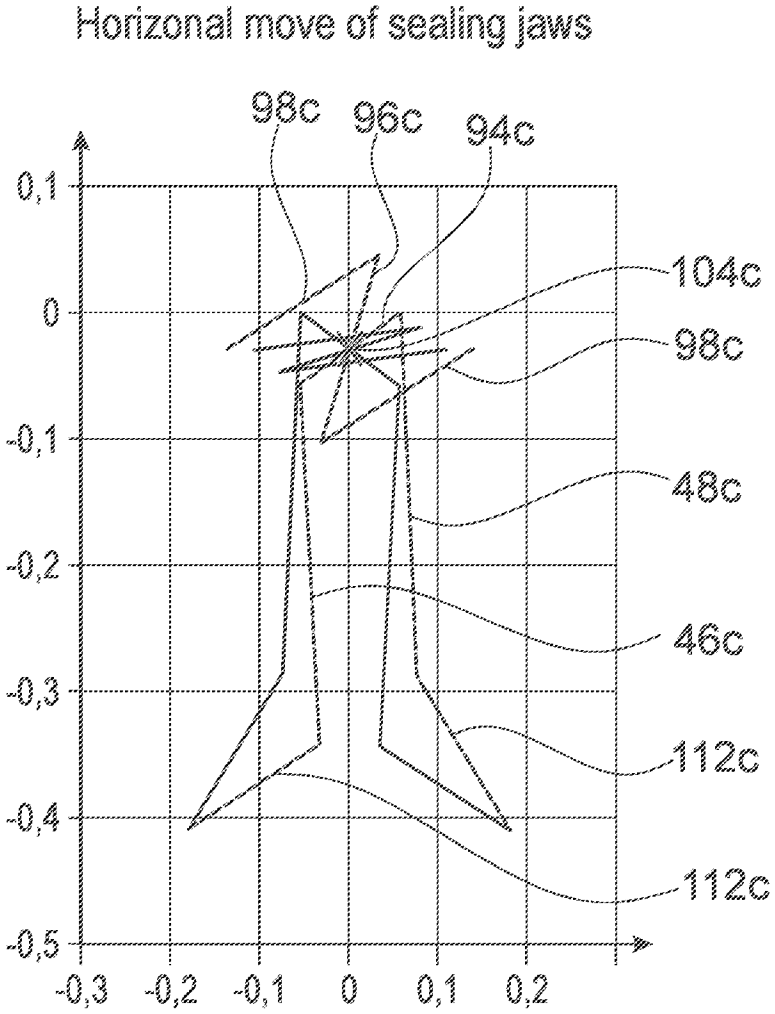
Figure 9A:
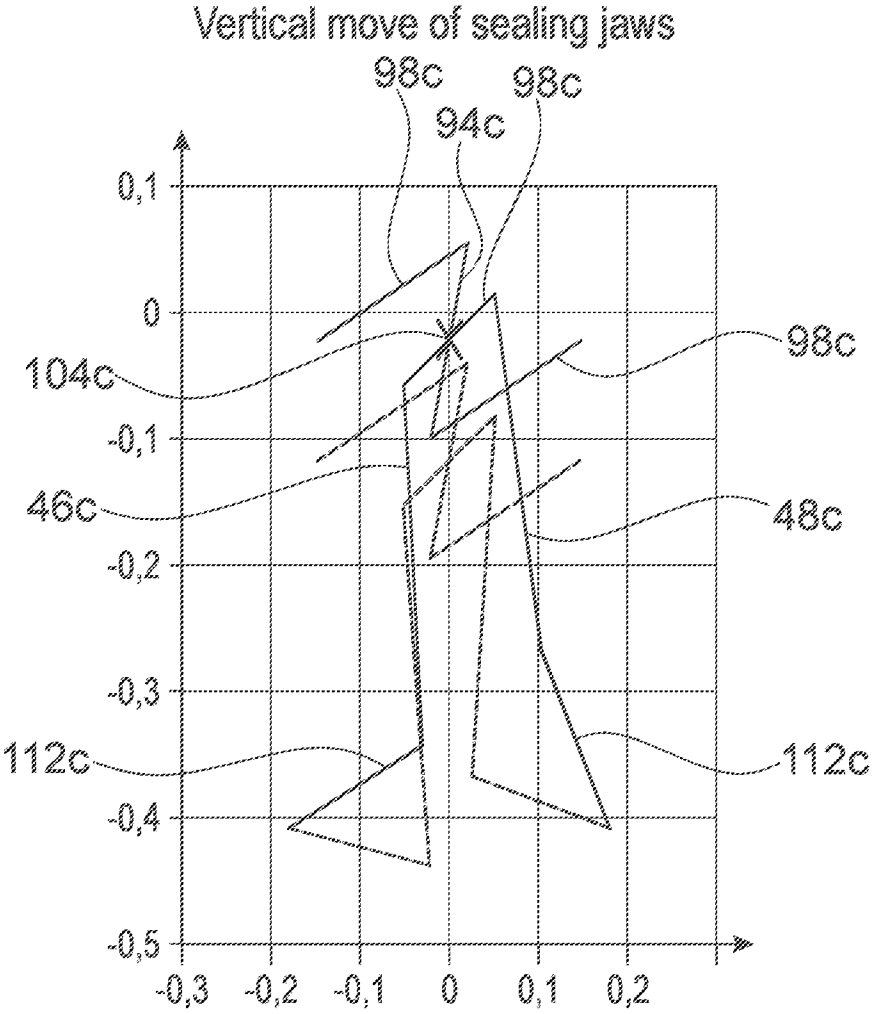

FIG. 9*a* schematically shows the movement unit 36*c* in two different vertical positions of the at least two sealing jaws 18*c*, 20*c*. The movement unit 36*c* shown in dashed lines is an arrangement of the movement unit 36*c* in a first vertical position of the at least two sealing jaws 18*c*, 20*c*. The movement unit 36*c* shown in continuous lines is an arrangement of the movement element 36*c* in a second vertical position of the at least two sealing jaws 18*c*, 20*c*. A relative arrangement of the two slider elements 98*c*, the additional movement element 96*c* and the drive connection element 94*c* of the movement unit 36*c* is fixed during a merely vertical movement of the at least two sealing jaws 18*c*, 20*c*.

FIG. 9*b* schematically shows the movement unit 36*c* in two different horizontal positions of the at least two sealing jaws 18*c*, 20*c* relative to each other. The movement unit 36*c* shown in dashed lines is an arrangement of the movement unit 36*c* in a first horizontal position of the at least two sealing jaws 18*c*, 20*c*. The movement unit 36*c* shown in continuous lines is an arrangement of the movement element 36*c* in a second horizontal position of the at least two sealing jaws 18*c*, 20*c*, in particular in the sealing position. A relative arrangement of the two slider elements 98*c*, the additional movement element 96*c* and the drive connection element 94*c* of the movement unit 36*c* is changed during a horizontal movement of the at least two sealing jaws 18*c*, 20*c* relative to each other.

Figure 10:
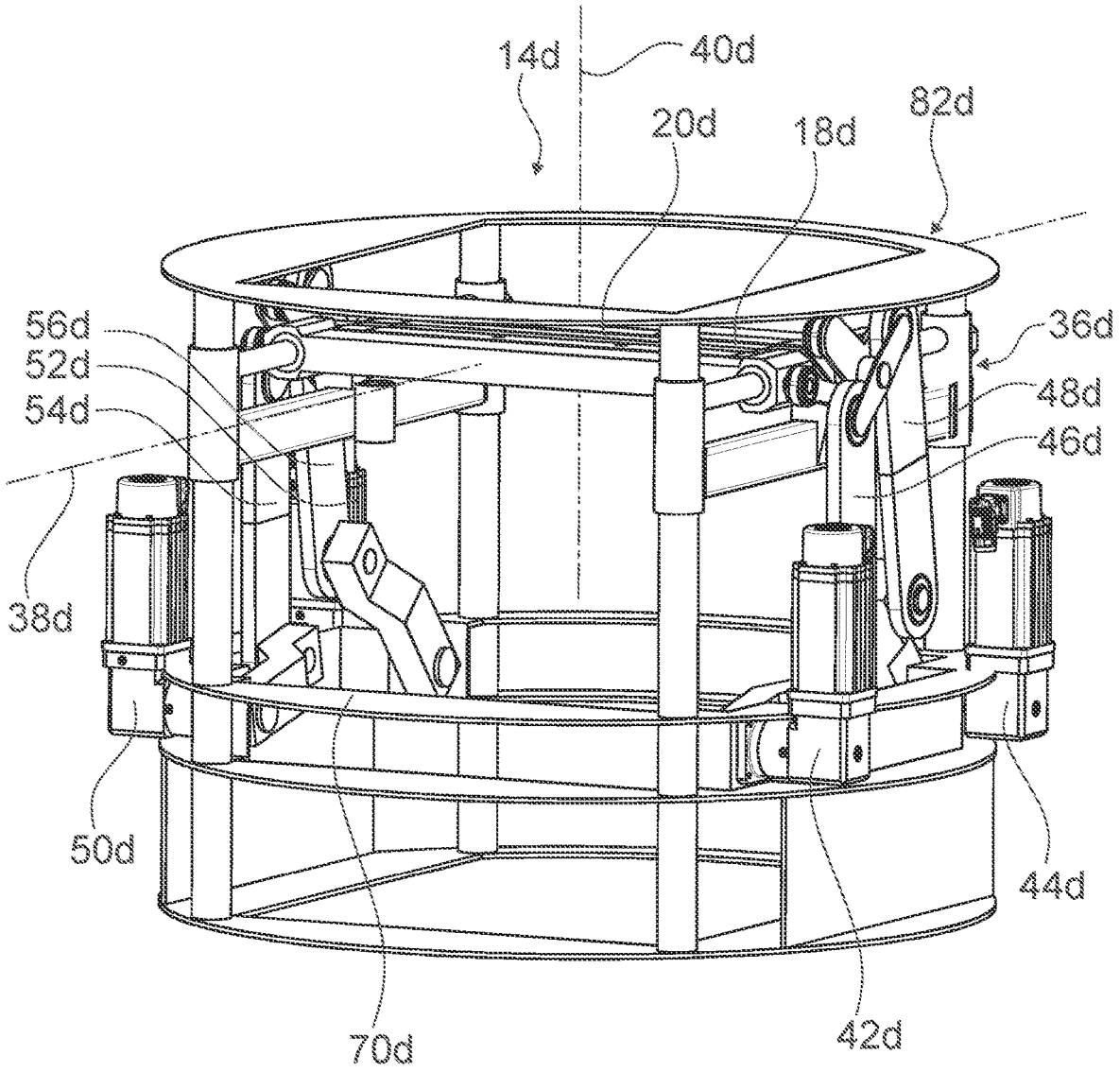

In FIG. 10 a transverse sealing device 14*d* is shown for a sealing of a package or a packaging material. The transverse sealing device 14*d* comprises at least two sealing jaws 18*d*, 20*d*. The transverse sealing device 14*d* comprises at least one movement unit 36*d*, which is configured for moving the at least two sealing jaws 18*d*, 20*d* translationally relative to each other along a direction parallel to a horizontal movement axis 38*d* of a guide unit 82*d* of the transverse sealing device 14*d* and for moving the at least two sealing jaws 18*d*, 20*d* translationally along a direction parallel to a vertical movement axis 40*d* of the guide unit 82*d* of the transverse sealing device 14*d*.

The movement unit 36*d* comprises at least four movement elements 46*d*, 48*d*, 54*d*, 56*d*. Each of four drive units 42*d*, 44*d*, 50*d*, 52*d* is mechanically connected to one of the four movement elements 46*d*, 48*d*, 54*d*, 56*d* for driving the four movement elements 46*d*, 48*d*, 54*d*, 56*d* so as to generate a vertical and/or horizontal movement of the at least two sealing jaws 18*d*, 20*d*. The at least four movement elements 46*d*, 48*d*, 54*d*, 56*d* correspond to the at least two movement elements 46*c*, 48*c* and the at least two further movement elements 54*c*, 56*c* of the embodiment of FIGS. 6 to 8. The four movement elements 46*d*, 48*d*, 54*d*, 56*d* are free from any direct connection to each other, in particular via a drive shaft, or the like. The four drive units 42*d*, 44*d*, 50*d*, 52*d* are arranged in an at least substantially positionally fixed manner relative to a frame 70*d* of the transverse sealing device 14*d*. The movement unit 36*d* is arranged at least substantially completely sideways relative to the at least two sealing jaws 18*d*, 20*d*, at least viewed in a direction parallel to the horizontal movement axis 38*d* of the guide unit 82*d* of the transverse sealing device 14*d*. The movement unit 36*d* is arranged sideways relative to the at least two sealing jaws 18*d*, 20*d* in such a way that the movement unit 36*c* is positioned at least substantially completely within a proximity area of the at least two sealing jaws 18*d*, 20*d*, at least viewed in the direction parallel to the horizontal movement axis 38*d* of the guide unit 82*d* of the transverse sealing device 14*d*. The at least two sealing jaws 18*d*, 20*d* are pullable into a sealing position by means of the movement unit 36*d*.

Figure 11:
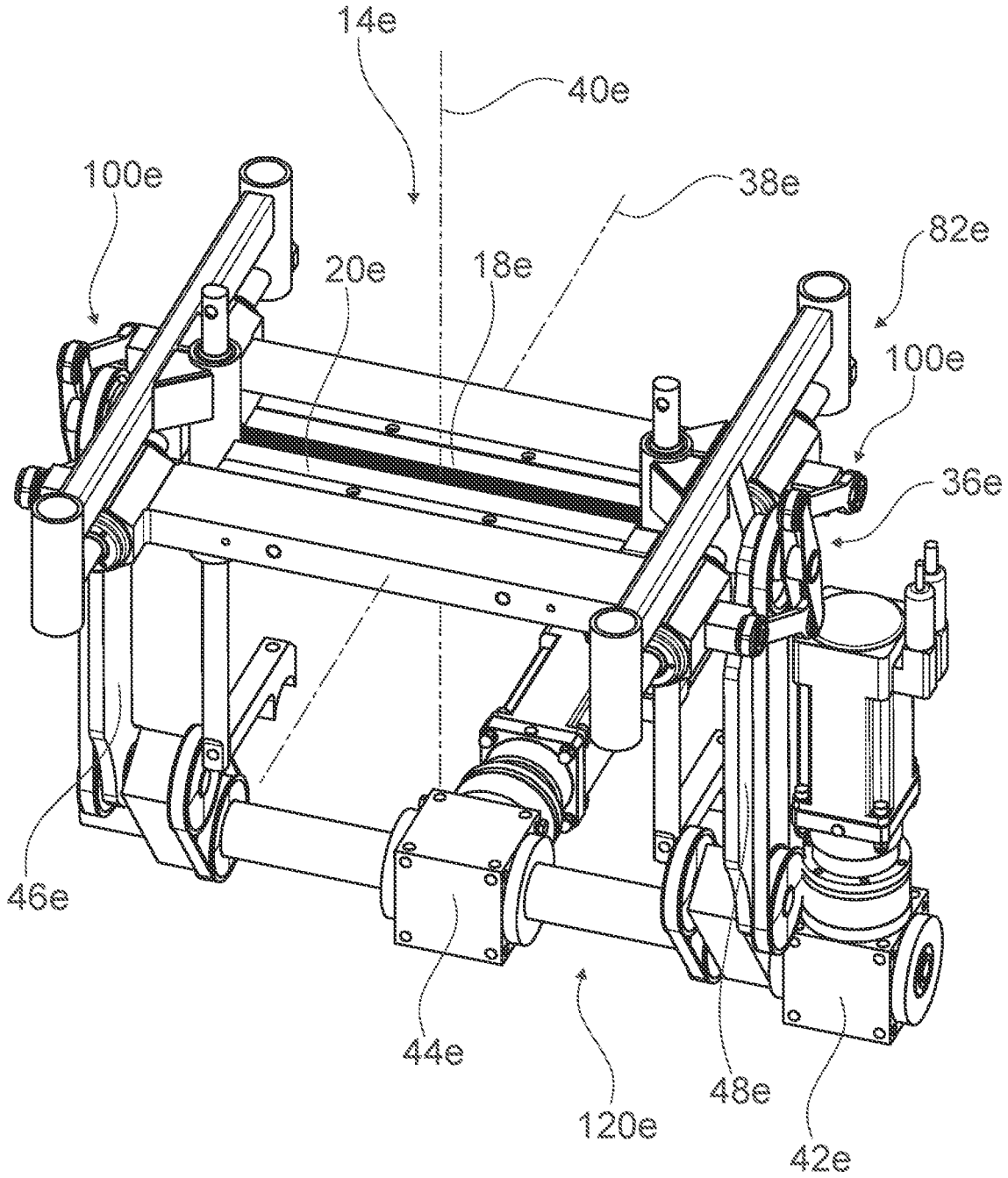

In FIG. 11 a transverse sealing device 14*e* is shown for a sealing of a package or a packaging material. The transverse sealing device 14*e* comprises at least two sealing jaws 18*e*, 20*e*. The transverse sealing device 14*e* comprises at least one movement unit 36*e*, which is configured for moving the at least two sealing jaws 18*e*, 20*e* translationally relative to each other along a direction parallel to a horizontal movement axis 38*e* of a guide unit 82*e* of the transverse sealing device 14*e* and for moving the at least two sealing jaws 18*e*, 20*e* translationally along a direction parallel to a vertical movement axis 40*e* of the guide unit 82*e* of the transverse sealing device 14*e*, in particular relative to a frame (not shown here) of the transverse sealing device 14*e*.

The movement unit 36*e* comprises at least two crank slider mechanisms 100*e*, which are in particular arranged on averted sides of the at least two sealing jaws 18*e*, 20*e*. The movement u nit 36*e* comprises a belt construction 120*e* for transmitting a driving force generatable by a drive unit 44*e* of the transverse sealing device 14*e* to the two crank slider mechanisms 100*e* in order to generate a horizontal movement of the at least two sealing jaws 18*e*, 20*e* relative to each other. The transverse sealing device 14*e* comprises a further drive unit 44*e* for generating a vertical movement of the at least two sealing jaws 18*e*, 20*e*, in particular relative to the frame. The movement unit 36*e* comprises two movement elements 46*e*, 48*e*, implemented as arms, for converting the driving force of the further drive unit 42*e* into a vertical movement of the at least two sealing jaws 18*e*, 20*e*.

The movement unit 36*e* is arranged at least substantially completely sideways relative to the at least two sealing jaws 18*e*, 20*e*, at least viewed in a direction parallel to the horizontal movement axis 38*e* of the guide unit 82*e* of the transverse sealing device 14*e*. The movement unit 36*e* is arranged sideways relative to the at least two sealing jaws 18*e*, 20*e* in such a way that the movement unit 36*e* is positioned at least substantially completely within a proximity area of the at least two sealing jaws 18*e*, 20*e*, at least viewed in the direction parallel to the horizontal movement axis 38*e* of the guide unit 82*e* of the transverse sealing device 14*e*. The at least two sealing jaws 18*e*, 20*e* are pullable into a sealing position by means of the movement unit 36*e*. The drive unit 44*e* and the further drive unit 42*e* are arranged in an at least substantially positionally fixed manner relative to the frame of the transverse sealing device 14*e*.

Figure 12:
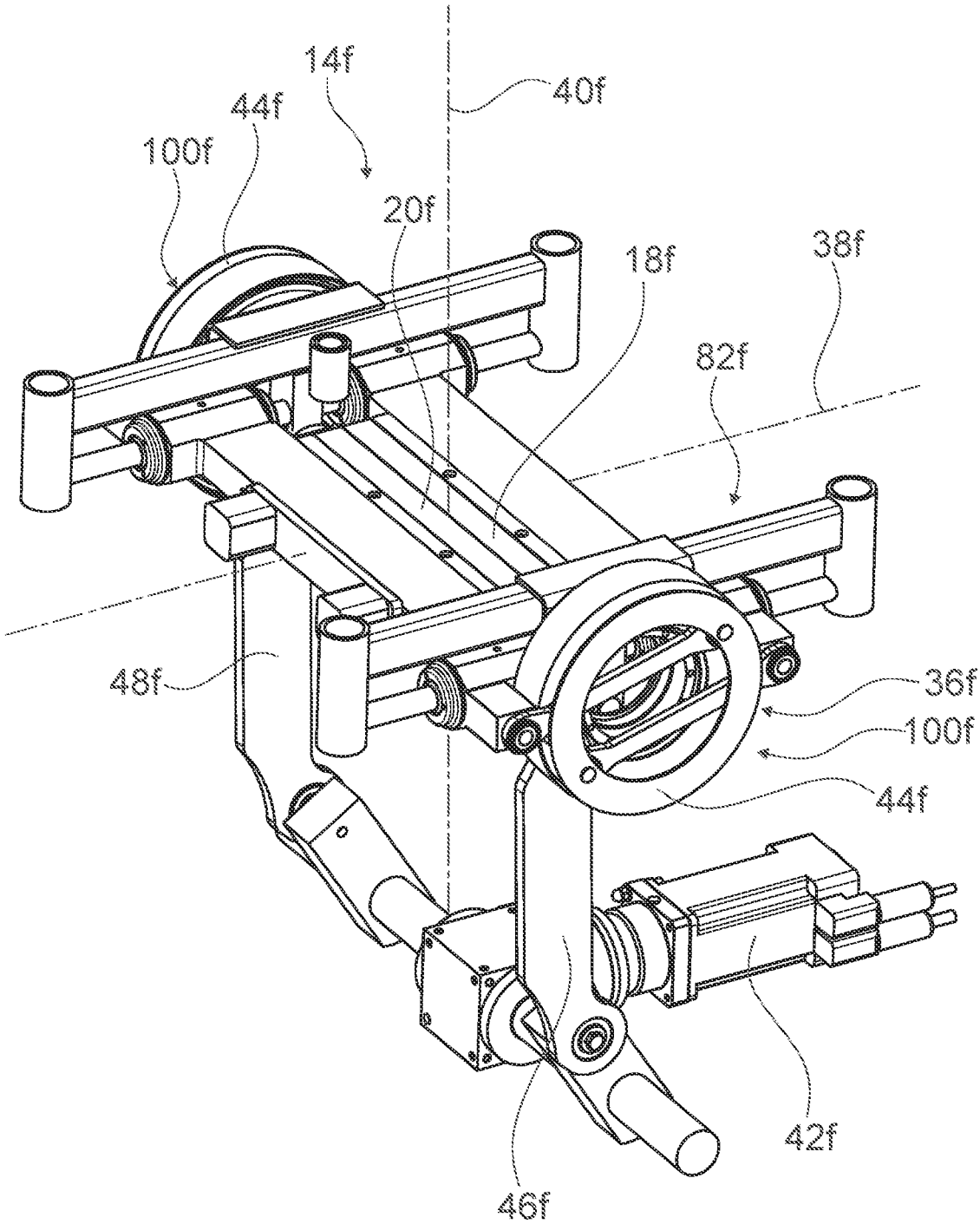

In FIG. 12 a transverse sealing device 14*f* is shown for a sealing of a package or a packaging material. The transverse sealing device 14*f* comprises at least two sealing jaws 18*f*, 20*f*. The transverse sealing device 14*f* comprises at least one movement unit 36*f*, which is configured for moving the at least two sealing jaws 18*f*, 20*f* translationally relative to each other along a direction parallel to a horizontal movement axis 38*f* of a guide unit 82*f* of the transverse sealing device 14*f* and for moving the at least two sealing jaws 18*f*, 20*f* translationally along a direction parallel to a vertical movement axis 40*f* of the guide unit 82*f* of the transverse sealing device 14*f*, in particular relative to a frame (not shown here) of the transverse sealing device 14*f*.

The movement unit 36*f* comprises at least two crank slider mechanisms 100*f*, which are in particular arranged on averted sides of the at least two sealing jaws 18*f*, 20*f*. The transverse sealing device 14*f* comprises two drive units 44*f*, wherein one of the two drive units 44*f* is arranged at one of the two crank slider mechanisms 100*f*. The two drive units 44*f* are configured for driving the two crank slider mechanisms 100*f* in order to generate a horizontal movement of the at least two sealing jaws 18*f*, 20*f* relative to each other. The two drive units 44*f* are attached to the two sealing jaws 18*f*, 20*f* in such a way that the at least two drive units 44*f* are moved along a direction parallel to a vertical movement axis of the at least two sealing jaws 18*f*, 20*f* relative to the frame. The transverse sealing device 14*f* comprises at least one further drive unit 42*f* for generating a driving force in order to move the at least two sealing jaws 18*f*, 20*f* along a direction parallel to the vertical movement axis 40*f*. The further drive unit 42*f* is arranged in an at least substantially positionally fixed manner relative to the frame. The movement unit 36*f* comprises two movement elements 46*f*, 48*f* configured for converting a driving force of the further drive unit 42*f* into a vertical movement of the at least two sealing jaws 18*f*, 20*f*. The movement unit 36*f* is arranged at least substantially completely sideways relative to the at least two sealing jaws 18*f*, 20*f*, at least viewed in a direction parallel to the horizontal movement axis 38*f* of the guide unit 82*f* of the transverse sealing device 14*f*. The movement unit 36*f* is arranged sideways relative to the at least two sealing jaws 18*f*, 20*f* in such a way that the movement unit 36*f* is positioned at least substantially completely within a horizontal movement area of the guide unit 82*f* of the transverse sealing device 14*f*, at least viewed in the direction parallel to the horizontal movement axis 38*f* of the guide unit 82*f* of the transverse sealing device 14*f*. The at least two sealing jaws 18*f*, 20*f* are pullable into a sealing position by means of the movement unit 36*f*.

Figure 13:
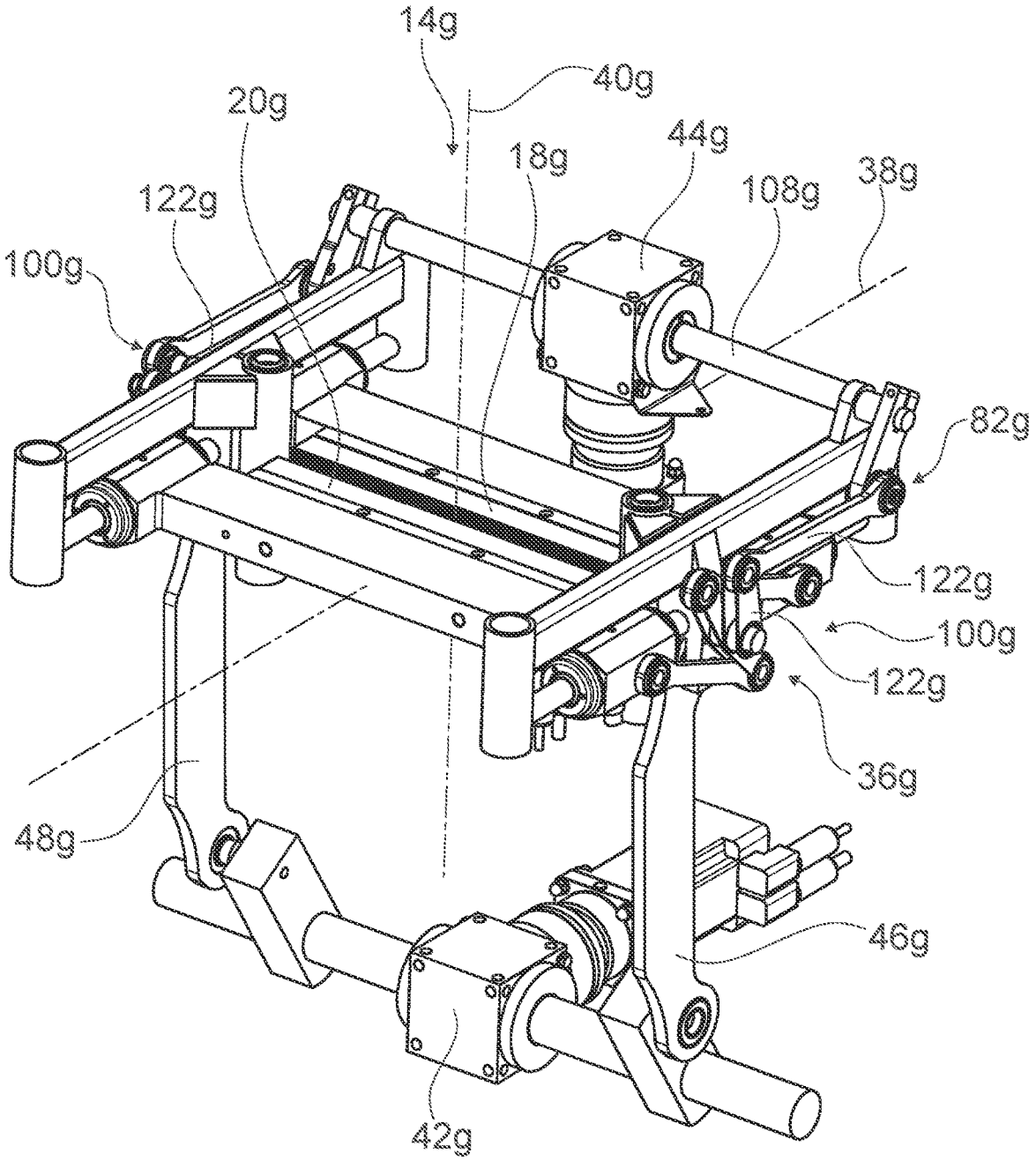

In FIG. 13 a transverse sealing device 14*g* is shown for a sealing of a package or a packaging material. The transverse sealing device 14*g* comprises at least two sealing jaws 18*g*, 20*g*. The transverse sealing device 14*g* comprises at least one movement unit 36*g*, which is configured for moving the at least two sealing jaws 18*g*, 20*g* translationally relative to each other along a direction parallel to a horizontal movement axis 38*g* of a guide unit 82*g* of the transverse sealing device 14*g* and for moving the at least two sealing jaws 18*g*, 20*g* translationally along a direction parallel to a vertical movement axis 40*g* of the guide unit 82*g* of the transverse sealing device 14*g*, in particular relative to a frame (not shown here) of the transverse sealing device 14*g*.

The movement unit 36*g* comprises at least two crank slider mechanisms 100*g*, which are in particular arranged on averted sides of the at least two sealing jaws 18*g*, 20*g*. The transverse sealing device 14g comprises a drive unit 44g for generating a driving force so as to move the at least two sealing jaws 18g, 20g horizontally. The drive unit 44g is arranged relative to the two sealing jaws 18g, 20g in such a way that the drive unit 44g is moved along with a vertical movement of the at least two sealing jaws 18g, 20g relative to the frame. The transverse sealing device 14g comprises at least one further drive unit 42g for generating a driving force so as to move the at least two sealing jaws 18g, 20g along the direction parallel to the vertical movement axis 40g. The further drive unit 42g is arranged in an at least substantially positionally fixed manner relative to the frame. The movement unit 36g comprises two movement elements 46g, 48g for converting a driving force of the further drive unit 42g into a vertical movement of the at least two sealing jaws 18g, 20g. The drive unit 44g comprises at least one drive shaft 108g, which is connected to the two crank slider mechanisms 100g, in particular via additional movement elements 122g of the movement unit 36g.

The movement unit 36g is arranged at least substantially completely sideways relative to the at least two sealing jaws 18g, 20g, at least viewed in a direction parallel to the horizontal movement axis 38g of the guide unit 82g of the transverse sealing device 14g. The movement unit 36g is arranged sideways relative to the at least two sealing jaws 18g, 20g in such a way that the movement unit 36g is positioned at least substantially completely within a proximity area of the at least two sealing jaws 18g, 20g, at least viewed in the direction parallel to the horizontal movement axis 38g of the guide unit 82g of the transverse sealing device 14g. The at least two sealing jaws 18g, 20g are pullable into a sealing position by means of the movement unit 36g.

What is claimed is:

1. A vertical form fill sealing machine (10a-10g) comprising:

a machine frame (12a-12g), at least one transverse sealing device (14a-14g) for a sealing of a packaging material transversely, wherein the at least one transverse sealing device (14a-14g) is mounted on the machine frame (12a-12g) such that the at least one transverse sealing device can be rotated around a rotation axis (16a-16g) of the at least one transverse sealing device (14a-14g) as a whole, and a first guide unit (32a-32g) to guide the rotation of the at least one transverse sealing device (14a-14g) around the rotation axis (16a-16g) as a whole, wherein the first guide unit (32a-32g) comprises at least one guide element (124a-124g) that delimits at least partially a circular cylindrical receiving area (126a-126g) within which the at least one transverse sealing device (14a-14g) is at least substantially completely arranged, wherein the at least one transverse sealing device (14a-14g) comprises at least one movement unit (36a-36g), at least two sealing jaws (18a-18g; 20a-20g) and at least one second guide unit (82a-82g) to guide the at least two sealing jaws (18a-18g, 20a-20g) during a movement, wherein the at least one movement unit (36a-36g) is provided for moving the at least two sealing jaws (18a-18g; 20a-20g) along a horizontal movement axis (38a-38g) of the at least one second guide unit (82a-82g) of the at least one transverse sealing device (14a-14g) and for moving the at least two sealing jaws (18a-18g; 20a-20g) along a vertical movement axis (40a-40g) of the at least one second guide unit (82a-82g) of the at least one transverse sealing device (14a-14g), wherein the at least one transverse sealing device (14a-14g) comprises at least two drive units (42a-42g, 44a-44g) for driving the at least one movement unit (36a-36g) so as to generate the horizontal movement and/or the vertical movement of the at least two sealing jaws (18a-18g; 20a-20g) relative to a frame (70a-70g) of the at least one transverse sealing device (14a-14g) and/or relative to the machine frame (12a-12g), wherein the first guide unit (32a-32g) has one or more bearing points, in which the frame (70a-70g) of the at least one transverse sealing device (14a-14g) is movably connected to the first guide unit (32a-32g), wherein all components of the at least one transverse sealing device (14a-14g) other than the frame (70a-70g) of the at least one transverse sealing device (14a-14g) are mounted on the frame (70a-70g) of the at least one transverse sealing device (14a-14g), wherein the frame (70a-70g) of the at least one transverse sealing device (14a-14g) is arranged rotatably on the machine frame (12a-12g), wherein all components of the at least one transverse sealing device (14a-14g) are simultaneously rotatable around the rotation axis (16a-16g) of the at least one transverse sealing device (14a-14g) relative to the machine frame (12a-12g).

2. The vertical form fill sealing machine (10a-10g) according to claim 1, wherein a main extension axis (136a-136g) of the circular cylindrical receiving area (126a-126g) is arranged within a proximity area of the rotation axis (16a-16g) of the at least one transverse sealing device (14a-14g).

3. The vertical form fill sealing machine (10a-10g) according to claim 1, wherein a main extension axis (136a-136g) of the circular cylindrical receiving area (126a-126g) is located in a proximity area of a sealing plane (22a-22g) of the at least two sealing jaws (18a-18g, 20a-20g).

4. The vertical form fill sealing machine (10a-10g) according to claim 1, wherein the at least one transverse sealing device (14a-14g) has a central axis (138a-138g), wherein a main extension axis (136a-136g) of the circular cylindrical receiving area (126a-126g) is arranged in a proximity area of the central axis (138a-138g).

5. The vertical form fill sealing machine (10a-10g) according to claim 1, wherein the at least one guide element (124a-124g) defines a circle-shaped guide way (140a-140g), wherein the at least one transverse sealing device (14a-14g) is arranged at least substantially completely within a circular cylinder (142a-142g) corresponding to the circle-shaped guideway (140a-140g).

6. The vertical form fill sealing machine (10a-10g) according to claim 1, wherein the at least one transverse sealing device (14a-14g) has at least partially a circle-shaped outside contour, at least viewed in a direction parallel to the rotation axis (16a-16g).

7. The vertical form fill sealing machine (10a-10g) according to claim 1, wherein the at least one guide element (124a-124g) encompasses the at least one transverse sealing device (14a-14g) in at least one rotational position of the at least one transverse sealing device (14a-14g) relative to the at least one guide element (124a-124g) by at least 75° along a circumferential direction of the at least one transverse sealing device (14a-14g).

8. The vertical form fill sealing machine (10a-10g) according to claim 1, further comprising a filling station (24*a*-24*g*) comprising at least one filling tube (26*a*-26*g*) for filling a package with content, wherein a main extension axis (136*a*-136*g*) of the circular cylindrical receiving area (126*a*-126*g*) is arranged within a proximity area of a central axis (28*a*-28*g*) of the at least one filling tube (26*a*-26*g*).

9. The vertical form fill sealing machine (10*a*-10*g*) according to claim 1, wherein the at least one guide element (124*a*-124*g*) has a guide groove (132*a*-132*g*) with an undercut.

10. A method for operating the vertical form fill sealing machine (10*a*-10*g*) of claim 1, rotating the at least one transverse sealing device (14*a*-14*g*) as a whole around the rotation axis (16*a*-16*g*) of the at least one transverse sealing device (14*a*-14*g*) relative to the machine frame (12*a*-12*g*) of the vertical form fill sealing machine (10*a*-10*g*), moving the at least two sealing jaws (18*a*-18*g*; 20*a*-20*g*) of the at least one transverse sealing device (14*a*-14*g*) of the vertical form fill sealing machine (10*a*-10*g*) along the vertical movement axis (40*a*-40*g*) of the second guide unit (82*a*-82*g*) of the at least one transverse sealing device (14*a*-14*g*) and/or along the horizontal movement axis (38*a*-38*g*) of the second guide unit (82*a*-82*g*) of the at least one transverse sealing device (14*a*-14*g*) via the at least one movement unit (36*a*-36*g*) of the at least one transverse sealing device (14*a*-14*g*).

* * * * *